US008938183B2

(12) United States Patent
Ishio

(10) Patent No.: US 8,938,183 B2
(45) Date of Patent: Jan. 20, 2015

(54) DOCTOR BLADE ASSEMBLY AND ALIGNMENT METHOD

(71) Applicant: Mitsubishi Kagaku Imaging Corporation, San Fernando, CA (US)

(72) Inventor: Kozo Ishio, Virginia Beach, VA (US)

(73) Assignee: Mitsubishi Kagaku Imaging Corp., Glendale, CA (US)

( * ) Notice: Subject to any disclaimer, the term of this patent is extended or adjusted under 35 U.S.C. 154(b) by 6 days.

(21) Appl. No.: 13/815,743

(22) Filed: Mar. 15, 2013

(65) Prior Publication Data

US 2014/0270844 A1 Sep. 18, 2014

(51) Int. Cl.
*G03G 15/08* (2006.01)

(52) U.S. Cl.
CPC ..... *G03G 15/0812* (2013.01)
USPC ..... 399/109; 399/351

(58) Field of Classification Search
USPC ..... 399/105, 351
See application file for complete search history.

(56) References Cited

U.S. PATENT DOCUMENTS

| | | | | |
|---|---|---|---|---|
| 7,945,200 | B2 | 5/2011 | Norris et al. | |
| 2010/0158581 | A1* | 6/2010 | Mori | 399/284 |
| 2011/0255898 | A1 | 10/2011 | Kashiide et al. | |

* cited by examiner

*Primary Examiner* — Clayton E Laballe
*Assistant Examiner* — Jas Sanghera

(57) ABSTRACT

There is provided a doctor blade assembly and method for alignment in a toner hopper of a toner printer cartridge. The doctor blade assembly has a holder portion. The holder portion has a first mounting end and a second mounting end. The holder portion further has a pair of recessed openings formed in the first mounting end and the second mounting end, respectively. The holder portion further has a pair of alignment elements each having an alignment through hole and each configured to fit in and correspond to each respective recessed opening. The doctor blade assembly further has a blade portion attached to the holder portion. The doctor blade assembly further has a pair of fastener members each configured for insertion through the alignment through hole and through the recessed opening.

18 Claims, 14 Drawing Sheets

40
40c
102b
102a
108c
106
102c
100
108b
46c
108a 48c
48
70
100
64c
56c
40
12b
40c
46c
16
18c
10c
20c 48c
48
70
54c
46c
8B
72c
16
40c
40
100
12a
100
48c
77c
70
50c
48
104b
104a
74c
78c
102c
76c
102a
60c
58c
100
72c
102b
46c
16

DOCTOR BLADE ASSEMBLY AND ALIGNMENT METHOD

BACKGROUND a. Field of the Invention

The disclosure relates to electrophotographic imaging devices, and in particular, devices and methods for manufacturing or remanufacturing toner printer cartridges.

b. Background Art

Printer cartridges, such as toner printer cartridges, are used in various electrophotographic imaging devices, such as laser printers, copiers, facsimile machines, and multifunction imaging devices. Once original equipment manufacturer (OEM) toner printer cartridges are used, they are often recycled and remanufactured. The process of remanufacturing a toner printer cartridge may include cleaning the cartridge, repairing damaged parts, replacing worn parts, reassembling with new parts, and replenishing the cartridge with toner. The process of remanufacturing a toner printer cartridge requires that the toner printer cartridge be disassembled so that access to the various component parts may be achieved, and further requires that the toner printer cartridge be reassembled for subsequent use.

The component parts of toner printer cartridges typically include a doctor blade or doctor bar, a toner hopper, a waste hopper, a wiper blade, a primary charge roller (PCR), a developer roller, and an organic photoconductive (OPC) drum. The term "doctor blade" is a commonly used term in the toner printer cartridge manufacturing and remanufacturing industries and refers to an elongated material that usually includes an elongated holder or rod with an elongated blade attached to the elongated holder or rod. The elongated holder or rod is usually made of metal, and the elongated blade may be made of plastic or metal. The elongated blade may be positioned at an angle from the elongated holder or rod and may be positioned proximate to the developer roller with a predetermined distance.

When the toner printer cartridge is in operation, the doctor blade or doctor blade assembly is typically stationary while the developer roller rolls next to the doctor blade. The doctor blade or doctor blade assembly ensures that the right amount of toner sticks to the developer roller. However, not all toner may be absorbed by the developer roller. The toner that is not absorbed by the developer roller typically accumulates around the developer roller. Since the doctor blade and the developer roller are separated by a relatively small predetermined space, the blade controls the thickness of the toner that adheres to the developer roller by scraping off toner that is not absorbed by the developer roller. If there is an excess amount of toner on the developer roller, the doctor blade scrapes off the excess amount. The developer roller then transfers the toner to the OPC drum. The OPC drum that is coated with toner then rolls over a sheet of paper, which is usually given a negative charge by the PCR. The charge of the paper is typically less negative than the charge of the toner, and thus the paper attracts the toner. The toner may be embedded on the paper according to the print pattern.

The doctor blade or doctor blade assembly and the developer roller are usually detached from the toner printer cartridge during the remanufacturing process for cleaning. After cleaning, the doctor blade or doctor blade assembly and the developer roller may be reassembled together usually manually with a screw driver. An assembler or user may align or position the doctor blade above the developer roller. The assembler or user may press on one side of the doctor blade or doctor blade assembly and then attach with fastener or attachment means, such as screws, the same side of the doctor blade to the toner printer cartridge. The assembler or user may then execute the same steps on the remaining side. Aligning and positioning the doctor blade or doctor blade assembly during replacement and remanufacture may require that the doctor blade or doctor blade assembly be aligned or positioned within a tenth of millimeters of an acceptable alignment or position point to maximize print quality during printing. Many known OEM toner printer cartridges are designed to have a doctor blade or doctor blade assembly that may have the capability of being adjustable in order to adjust the doctor blade position. Thus, it may be difficult for the remanufacturer to manually align the doctor blade or doctor blade assembly to the correct position.

Known methods of assembly, manufacture, or remanufacture of toner printer cartridges may not provide a uniform distance between the doctor blade or doctor blade assembly and the developer roller from one side of the doctor blade to the other. As a result, the print quality may be affected, as the toner level on the developer roller is not effectively regulated by the doctor blade. One side of the developer roller may produce darker images than the other, or vice-versa. Moreover, known methods of assembly, manufacture, or remanufacture of toner printer cartridges, such as positioning or aligning a doctor blade or doctor blade assembly, may require an assembler or user to manually align and position the doctor blade or doctor blade assembly and may result in misalignment or damage to the doctor blade or doctor blade assembly. For example, an assembler or user may have to manually hold the doctor blade or doctor blade assembly in order to tighten fasteners such as screws to secure the doctor blade or doctor blade assembly to the toner hopper.

In addition, known methods of assembly or remanufacture of toner printer cartridges may require permanent attachment of two or more spacers, inserts, shims, or other spacing elements within the gap or area formed between the doctor blade or doctor blade assembly and the printer cartridge body in order to maintain a desired gap or area distance. The use of such permanent spacers, inserts, shims, or other spacing elements may increase the overall cost and complexity and decrease the overall efficiency of the assembly, manufacturing, or remanufacturing processes. Moreover, such spacers, inserts, shims, or spacing elements may have to have a required thickness that may limit the type of spacer, insert, shim, or spacing element that may be used.

In addition, known methods of assembly or remanufacture of toner printer cartridges may require the use of fixture elements to hold the doctor blade or doctor blade assembly and/or toner hopper and/or toner printer cartridge in place while positioning and aligning the doctor blade or doctor blade assembly. The use of such fixture elements may increase the overall cost and complexity and decrease the overall efficiency of the assembly, manufacturing, or remanufacturing processes.

Accordingly, there is a need for an improved doctor blade assembly and method for aligning doctor blade assemblies in toner hoppers of toner printer cartridges, that overcomes the issues associated with known devices and methods.

SUMMARY

This need for an improved doctor blade assembly and method for aligning doctor blade assemblies in toner hoppers of toner printer cartridges is satisfied.

There is provided in one embodiment a doctor blade assembly for alignment in a toner hopper of a toner printer cartridge. The doctor blade assembly comprises a holder portion. The holder portion comprises a first mounting end and a second mounting end. The holder portion further comprises a pair of recessed openings formed in the first mounting end and the second mounting end, respectively. The holder portion further comprises a pair of alignment elements each having an alignment through hole and each configured to fit in and correspond to each respective recessed opening. The doctor blade assembly further comprises a blade portion attached to the holder portion. The doctor blade assembly further comprises a pair of fastener members each configured for insertion through the alignment through hole and through the recessed opening.

There is provided in another embodiment a toner printer cartridge. The toner printer cartridge comprises a toner hopper. The toner printer cartridge further comprises a doctor blade assembly for alignment on the toner hopper. The doctor blade assembly comprises a holder portion. The holder portion comprises a first elongated positioning portion having a first mounting end and a second mounting end, a second elongated positioning portion substantially perpendicular to the first elongated positioning portion, a pair of recessed openings formed in the first mounting end and the second mounting end, respectively, a pair of alignment elements each having an alignment through hole and each configured to fit in and correspond to each respective recessed opening. The doctor blade assembly further comprises a blade portion attached along the first elongated positioning portion between the pair of recessed openings. The doctor blade assembly further comprises a pair of fastener members each configured for insertion through the alignment through hole of the alignment elements and through the recessed openings. The doctor blade assembly does not require use of a spacing element or a fixture element to align or to adjust a desired alignment position of the doctor blade assembly in the toner hopper of the toner printer cartridge.

There is provided in another embodiment a method for aligning a doctor blade assembly in a toner hopper of a toner printer cartridge. The method comprises the step of cutting a pair of recessed openings through a first mounting end and a second mounting end of a holder portion of a doctor blade assembly, and obtaining a pair of removable cut-out portions corresponding to the pair of recessed openings. The method further comprises the step of forming a predetermined alignment through hole in each of the cut-out portions, and obtaining an alignment element. The method further comprises the step of positioning the doctor blade assembly in a toner hopper of a toner printer cartridge, wherein the toner hopper has a pair of positioning pins at each end. The method further comprises the step of aligning the respective alignment through holes, the recessed openings, and the positioning pins along a substantially straight alignment pathway. The method further comprises the step of inserting a pair of fastener members through the respective alignment through holes and the recessed openings to set the doctor blade assembly in a desired alignment position.

The above description sets forth, rather broadly, a summary of the disclosed embodiments so that the detailed description that follows may be better understood and contributions of the invention to the art may be better appreciated. Some of the disclosed embodiments may not include all of the features or characteristics listed in the above summary. There may be, of course, other features of the disclosed embodiments that will be described below and may form the subject matter of claims. The features, functions, and advantages that have been discussed can be achieved independently in various embodiments of the disclosure or may be combined in yet other embodiments further details of which can be seen with reference to the following description and drawings.

DESCRIPTION OF DRAWINGS

The invention can be better understood with reference to the following detailed description taken in conjunction with the accompanying drawings which illustrate preferred and exemplary embodiments, but which are not necessarily drawn to scale, wherein.

DETAILED DESCRIPTION

Figure 1:
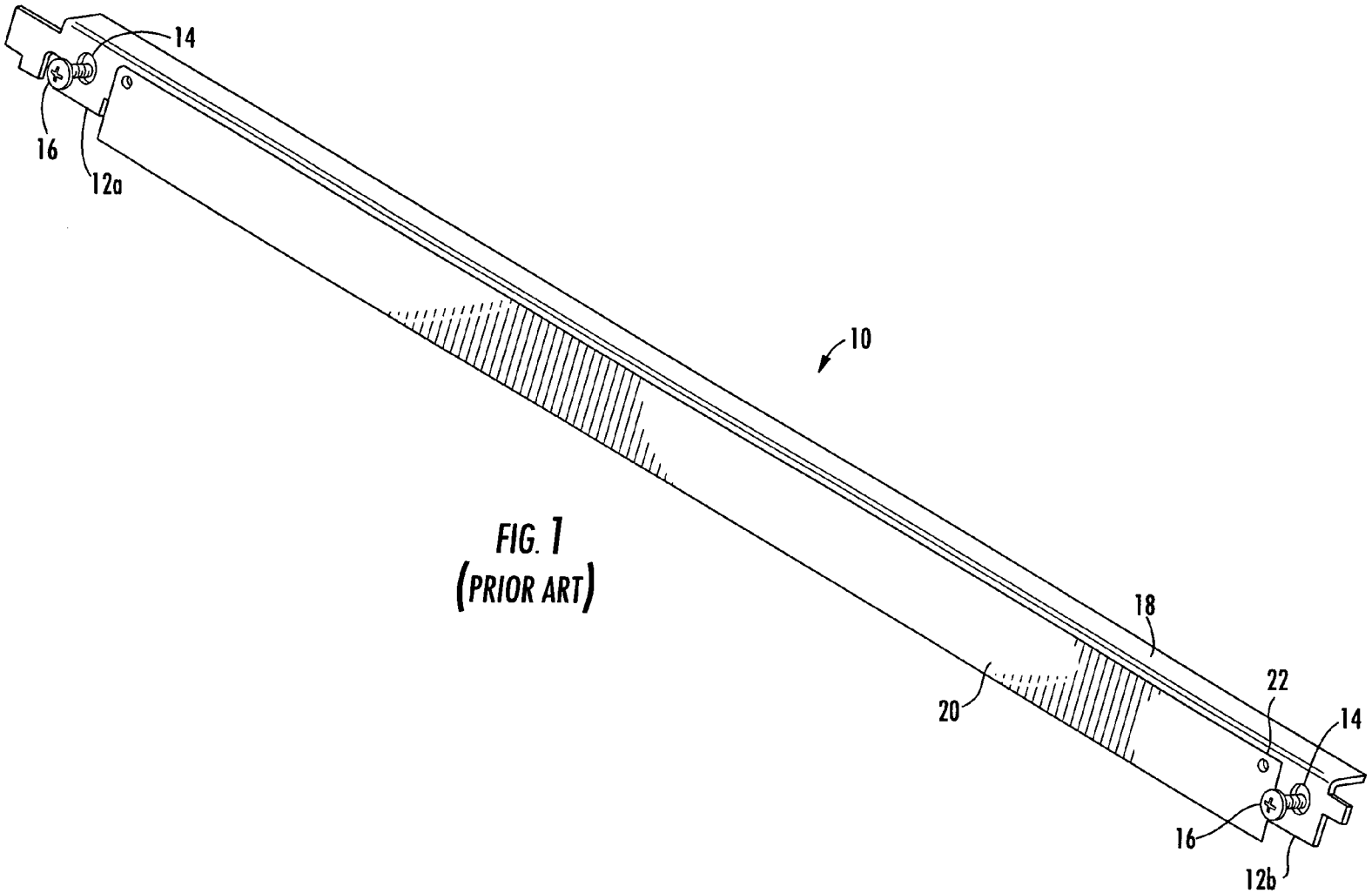
FIG. 1 (PRIOR ART)
FIG. 1 shows a front perspective view of a known doctor blade assembly for use in a toner printer cartridge.

Disclosed embodiments will now be described more fully herein after with reference to the accompanying drawings, in which some, but not all disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

The disclosed embodiments provide various devices and methods for manufacturing and remanufacturing printer cartridges, such as toner printer cartridges, and in particular, for aligning and positioning a doctor blade in a toner hopper of a toner printer cartridge or remanufactured toner printer cartridge. The disclosed embodiments of the devices and methods may be used with toner printer cartridges that can be used in laser printer models, such as, Hewlett Packard (HP) Company families of laser printers, for example, HP 4600, HP4700, HP5500, HP2600, HP CP1518, HP CP2025, HP CP3525, HP CP4525, HP CP5525, HP CP6015, HP CP1025, or may also be used with other suitable toner printer cartridges. It is known that a color printer cartridge requires accurate doctor blade alignment to maximize the print quality and the toner consumption.

Embodiments of a doctor blade assembly 10*a* (see FIG. 4A) for alignment in a toner hopper 56*a* (see FIG. 4B) of a toner printer cartridge 11 (see FIG. 4B), and a method 200 (see FIG. 11) for aligning a doctor blade assembly 10*a* (see FIG. 4A) in a toner hopper 56*a* (see FIG. 4B) of a toner printer cartridge 11 (see FIG. 4B) are provided. Embodiments of the doctor blade assembly 10*a* (see FIG. 4A) and method 200 (see FIG. 11) enable placement and alignment of the doctor blade assembly 10*a* at a desired alignment position 80*a* (see FIG. 4D) without having to use a spacing element 36 (see FIG. 3A) or a fixture element 37 (see FIG. 3A) to align or to adjust a desired alignment position 80*a* (see FIG. 4D) of the doctor blade assembly 10*a* in the toner hopper 34 (see FIG. 4D) of the toner printer cartridge 11 (see FIG. 4D).

The sizes, shapes, orientations, and positions of the doctor blade assembly 10*a* (see FIG. 4B), 10*b* (see FIG. 6A), and 10*c* (see FIG. 8A) may vary depending on the design of the toner hopper 56*a* (see FIG. 4B), 56*b* (see FIG. 6A), and 56*c* (see FIG. 8A) and the design and model of the toner printer cartridge 11 (see FIG. 4B), such as a newly manufactured toner printer cartridge or a remanufactured toner printer cartridge intended to be used embodiments of the doctor blade assembly disclosed herein.

Figure 3A:
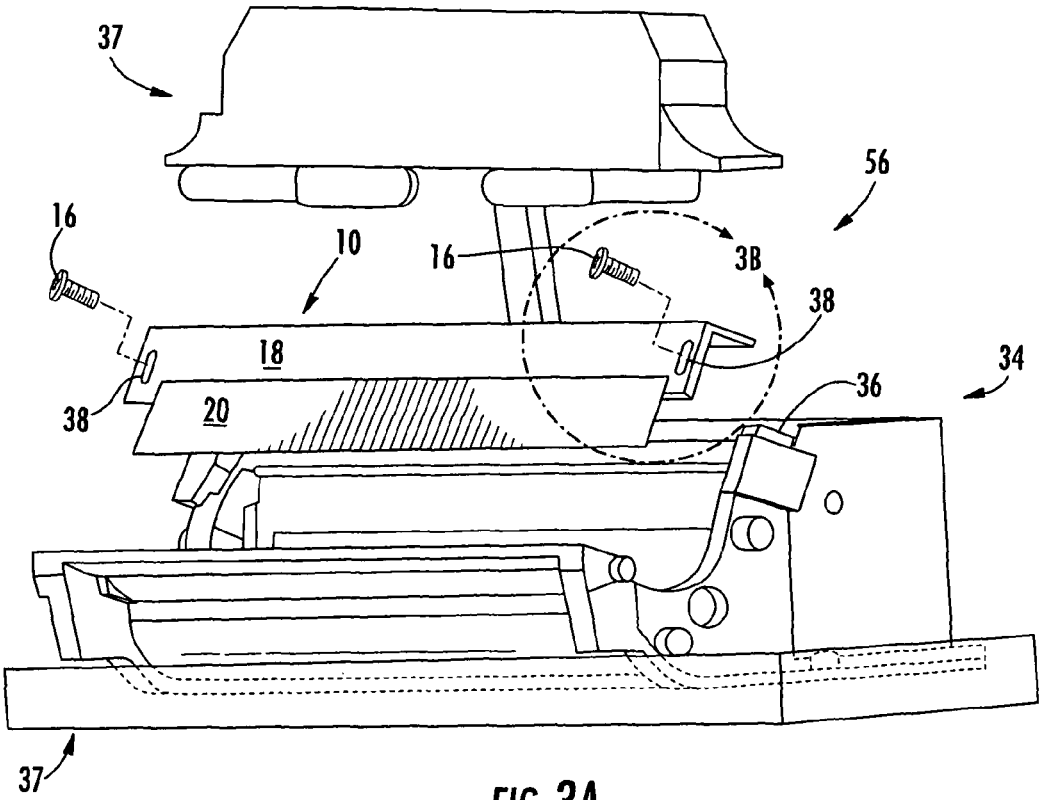
FIG. 3A (PRIOR ART)
FIG. 3A shows a front perspective view of a known doctor blade assembly being positioned in a toner printer cartridge with use of a fixture element and a spacing element.

Referring to the Figures, FIG. 1 shows a front perspective view of a known doctor blade assembly 10 for use in known toner printer cartridges 34 (see FIG. 3A). As shown in FIG. 1, the known doctor blade assembly 10 comprises a holder portion 18 having a first mounting end 12*a* and a second mounting end 12*b*. The first mounting end 12*a* and the second mounting end 12*b* each have an opening 14 configured to receive a fastener member 16 for attachment to a toner hopper 56 (see FIG. 3A) of a known toner printer cartridge 34 (see FIG. 34). As shown in FIG. 1, the known doctor blade assembly 10 further comprises a blade portion 20 attached to the holder portion 18 along attachment portion 22.

Figure 2:
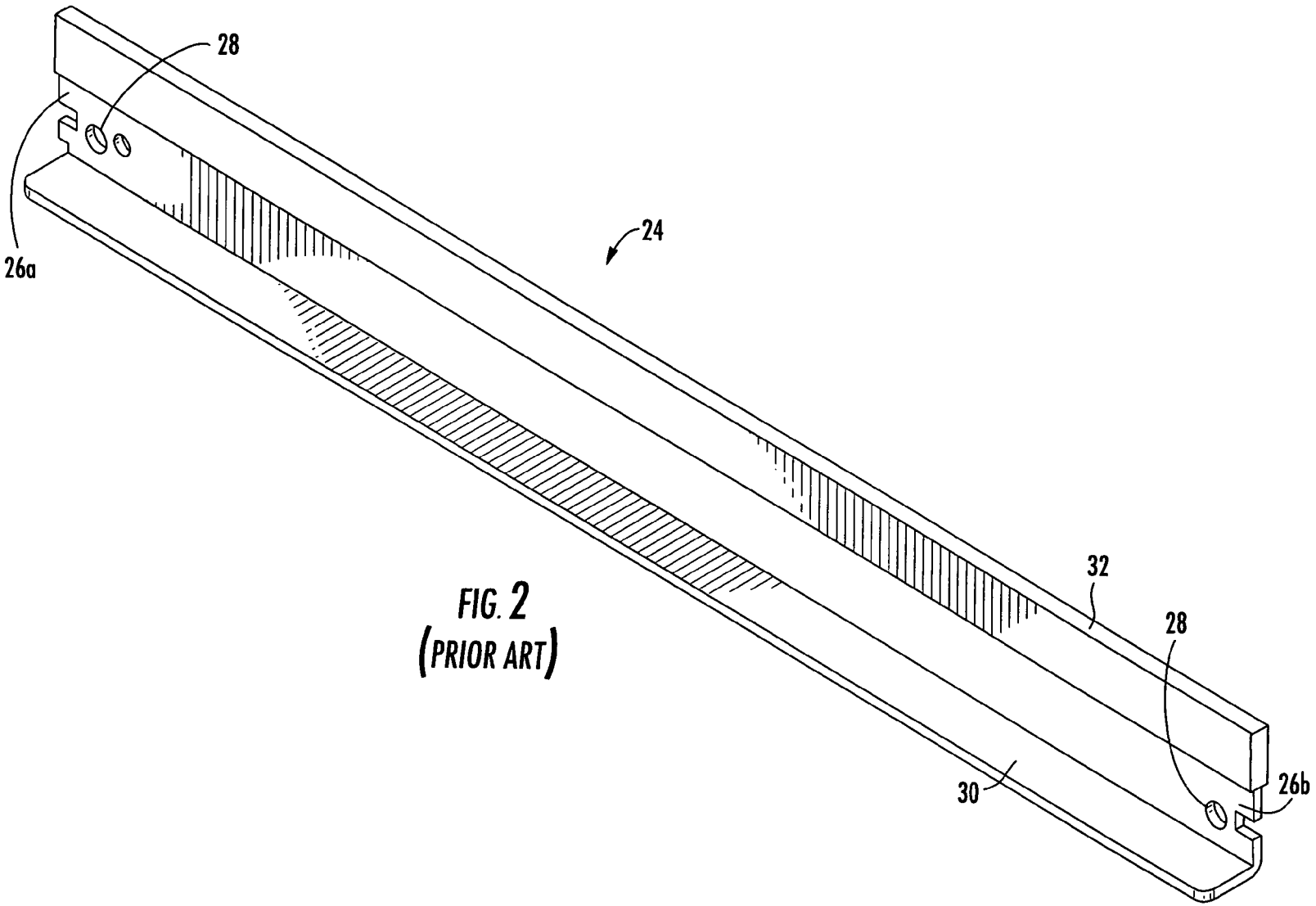
FIG. 2 (PRIOR ART)
FIG. 2 shows a front perspective view of a known wiper blade assembly for use in a toner printer cartridge.

FIG. 2 shows a front perspective view of a known wiper blade assembly 24 typically used in known toner printer cartridges 34 (see FIG. 3A). As shown in FIG. 2, the known wiper blade assembly 24 comprises a support portion 30 having a first mounting end 26*a* and a second mounting end 26*b*. The first mounting end 26*a* and the second mounting end 26*b* each have an opening 28 configured to receive a fastener member 16 (see FIG. 1) for attachment to a toner hopper 56 (see FIG. 3A) of a known toner printer cartridge 34 (see FIG. 34). As shown in FIG. 2, the known wiper blade assembly 24 further comprises a blade portion 32 attached to the holder portion 30.

Figure 3B:
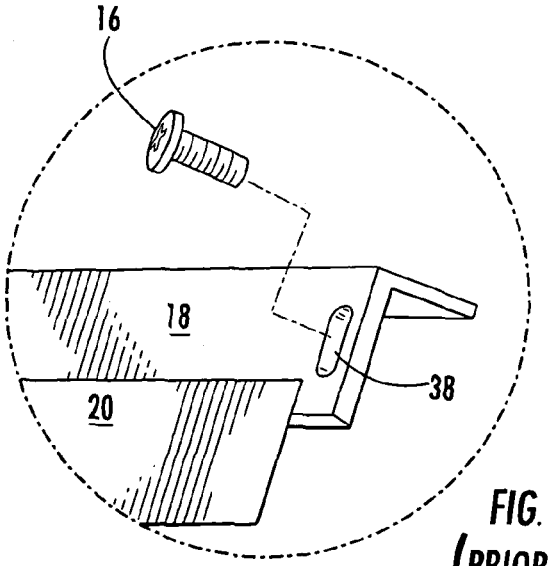
FIG. 3B (PRIOR ART)
FIG. 3B shows an enlarged front perspective view of the circle 3B of FIG. 3A and shows a slot opening on the known doctor blade assembly to enable position adjustment of the known doctor blade assembly.

FIG. 3A shows a front perspective view of a known doctor blade assembly 10 being positioned in a toner hopper 56 of a known toner printer cartridge 34. As shown in FIG. 3A, the known doctor blade assembly 10 has the holder portion 18 and the attached blade portion 20. The holder portion 18 has slot openings 38 (see FIG. 3A) formed in each end and adapted to receive fastener members 16 (see FIG. 3A). FIG. 3A further shows the known toner printer cartridge 34 positioned within a fixture element 37, such as a known doctor blade alignment fixture, that may be used to assist in positioning and aligning the doctor blade assembly 10. FIG. 3A further shows a spacing element 36 positioned on the toner hopper 56 for use in positioning and aligning the doctor blade assembly 10. FIG. 3B shows an enlarged front perspective view of the circle 3B of FIG. 3A and shows the slot opening 38 on the holder portion 18 of the known doctor blade assembly 10 configured to receive fastener member 16 and configured to enable position adjustment of the known doctor blade assembly 10.

Figure 4A:
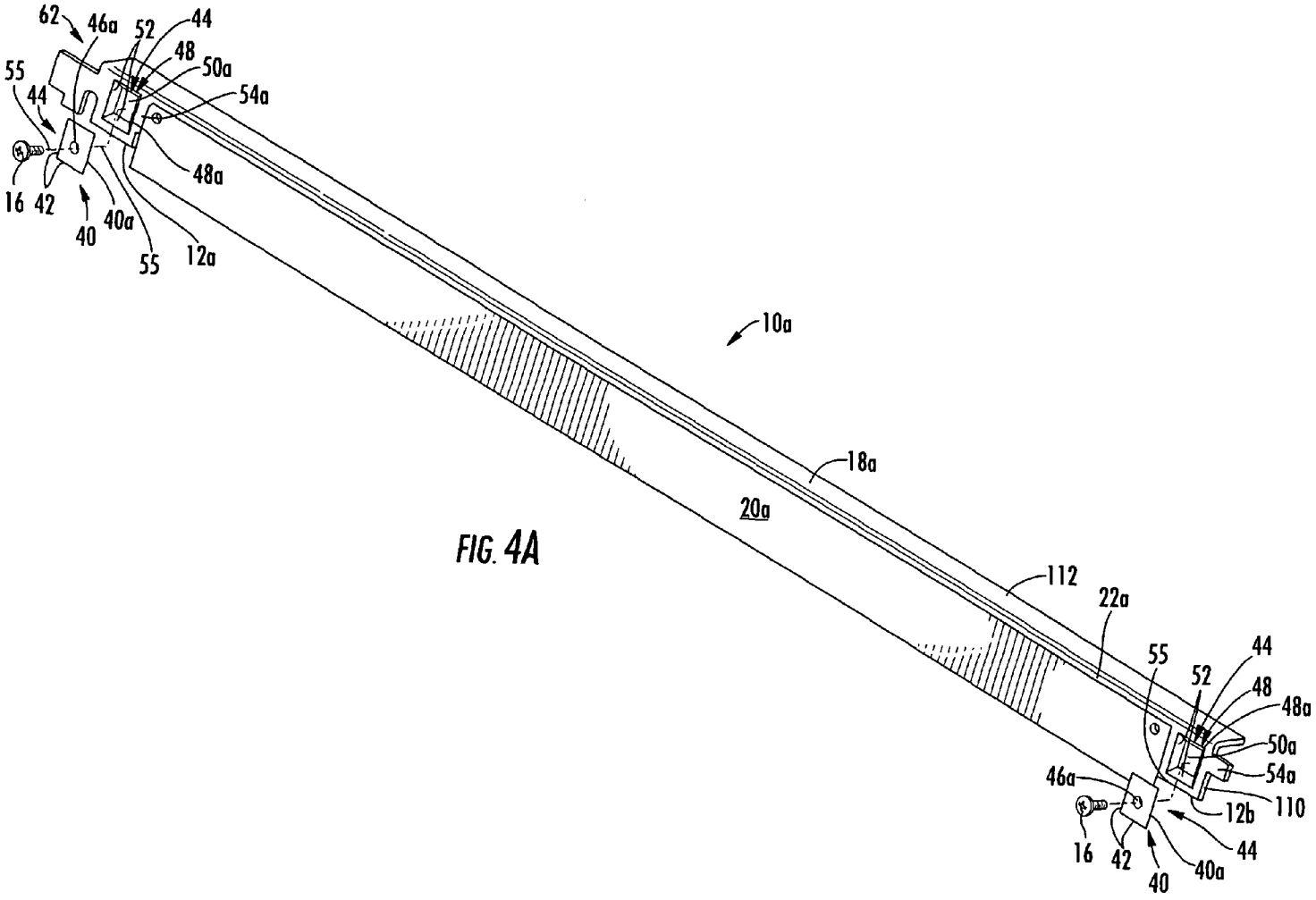
FIG. 4A shows a front perspective view of one of the embodiments of a doctor blade assembly of the disclosure in a nonaligned position and having alignment elements and recessed openings with a rectangle shape.

As disclosed herewith, embodiments of the doctor blade assembly 10*a* (see FIG. 4A), doctor blade assembly 10*b* (see FIG. 6A), doctor blade assembly 10*c* (see FIG. 8A), for alignment in a toner hopper 56*a* (see FIG. 4B) of a toner printer cartridge 11 (see FIG. 4B) are provided. FIGS. 4A-4D show one of the embodiments of the doctor blade assembly 10*a*. FIG. 4A shows a front perspective view of the doctor blade assembly 10*a* in a pre-aligned position 62 and having alignment elements 40 with a rectangle shape 44. As shown in FIG. 4A, the doctor blade assembly 10*a* comprises a holder portion 18*a*. As shown in FIG. 4A, the holder portion 18*a* comprises a first elongated positioning portion 110 having a first mounting end 12*a* and a second mounting end 12*b*. As further shown in FIG. 4A, the holder portion 18*a* comprises a second elongated positioning portion 112 substantially perpendicular to the first elongated positioning portion 100.

Figures 4B, 4C:
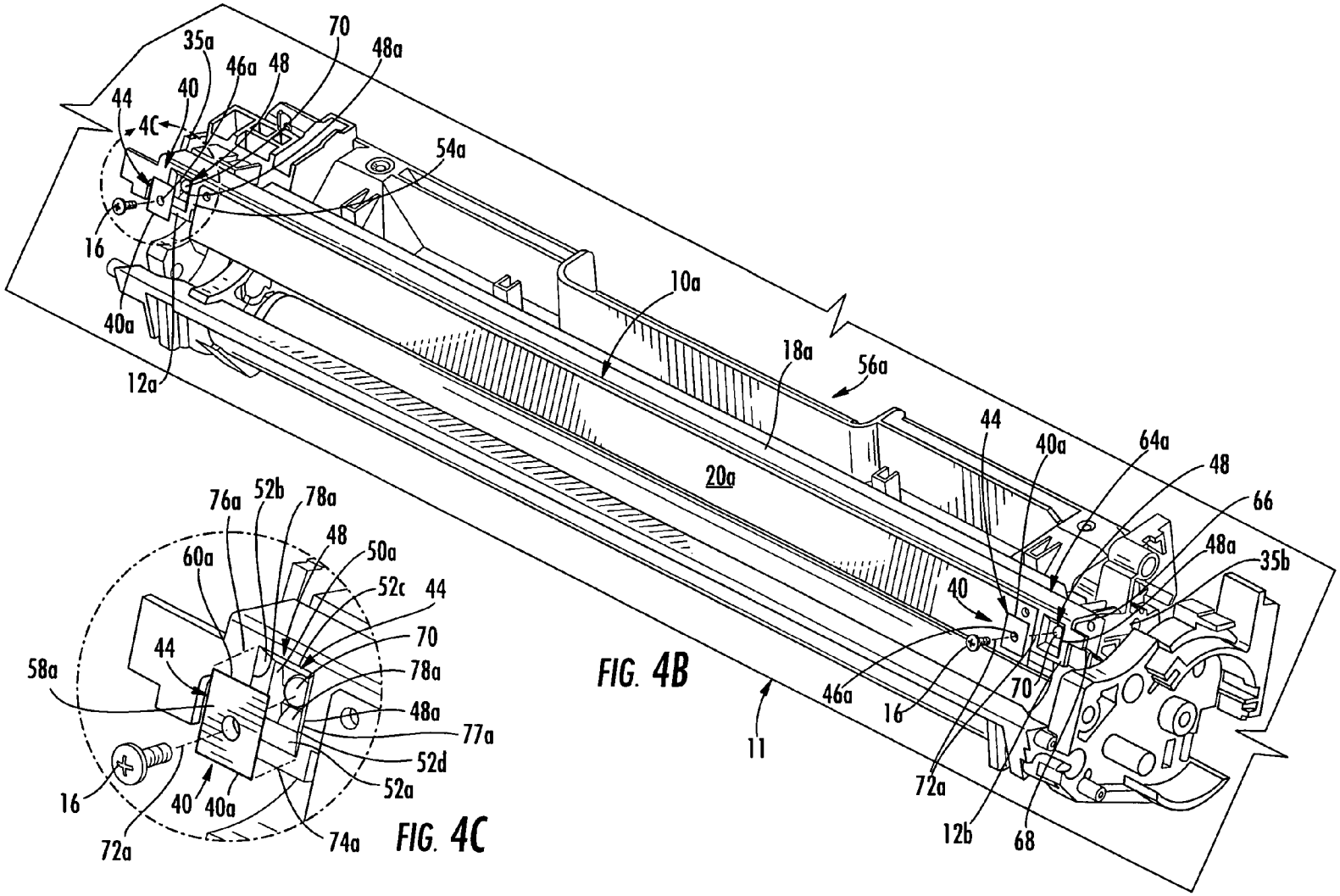
FIG. 4B shows a front perspective view of the doctor blade assembly of FIG. 4A in a partially aligned position in a toner hopper in a toner printer cartridge.
FIG. 4C shows an enlarged front perspective view of the circle 4C of FIG. 4B showing an alignment element and a recessed opening with a rectangle shape.

As further shown in FIG. 4A, the holder portion 18*a* comprises a pair of recessed openings 48, such as in the form of recessed openings 48*a*, having a rectangle shape 44, and formed at portions 54*a* in the first mounting end 12*a* and in the second mounting end 12*b*, respectively. As further shown in FIG. 4A, each recessed opening 48 further comprises an outer profile 77*a* (see FIG. 4C) and an inner profile 78*a* (see FIG. 4C). As shown in FIG. 4C, the outer profile shape 77*a* and the inner profile shape 78*a* are in a rectangle shape 44. Although the recessed opening 48 shown in the embodiment of FIG. 4C has a rectangle shape 44, the recessed opening 48 may have an outer profile and an inner profile in another geometric shape, such as including a trapezoid shape 90 (see FIG. 6B), a triangle shape (see FIG. 8B), a square shape (not shown), a pentagon shape (not shown), a hexagon shape (not shown), a circle shape (not shown), an oval shape (not shown), or another suitable shape.

As further shown in FIG. 4A, each recessed opening 48, such as in the form of recessed opening 48*a*, has an open portion 50*a*, angled sidewalls 52, such as first angled sidewall 52*a* (see FIG. 4C), second angled sidewall 52*b* (see FIG. 4C), third angled sidewall 52*c* (see FIG. 4C), and fourth angled sidewall 52*d* (see FIG. 4C). Although the recessed opening 48 shown in the embodiment of FIG. 4C has angled sidewalls, the recessed opening 48 may in another embodiment have straight sidewalls, such as shown in FIG. 10E. FIG. 10E shows a recessed opening 48, such as in the form of recessed opening 48*d*, having a first straight sidewall 124*a*, a second straight sidewall 124*b*, a third straight sidewall 124*c*, and a fourth straight sidewall 124*d*. In another embodiment, the recessed opening 48 may have a combination of one or more angled sidewalls and one or more straight sidewalls.

As further shown in FIG. 4A, the holder portion 18*a* of the doctor blade assembly 10*a* comprises a pair of alignment elements 40, such as in the form of alignment elements 40*a*. As further shown in FIG. 4A, each alignment element 40 has an alignment through hole 46*a*, and each alignment element 40 is configured to fit in and correspond to each respective recessed opening 48. Each alignment element 40 (see FIG. 4A), such as in the form of alignment element 40*a*, has an outer profile shape 42 (see FIG. 4A), such as a rectangle shape 44 (see FIG. 4A). Although the alignment element 40 shown in the embodiment of FIG. 4A has a rectangle shape 44, the alignment element 40 may have an outer profile shape in another geometric shape such as including a trapezoid shape 90 (see FIG. 6B), a triangle shape (see FIG. 8B), a square shape (not shown), a pentagon shape (not shown), a hexagon shape (not shown), a circle shape (not shown), an oval shape (not shown), or another suitable shape. It is preferable that the shape of the alignment element 40 has an asymmetric side in at least one direction to prevent it from turning upside down when the alignment through hole 46*a* is not at the center of the alignment element 40. The alignment elements 40 may be in the form of chips or small pieces formed from cut-out portions 39 (see FIG. 10A) removed after the recessed openings 48 have been cut into the first mounting end 12*a* and the second mounting end 12*b* of the holder portion 18*a*. The alignment through hole 46*a* (see FIG. 4A) is preferably formed such as by drilling or cutting through the cut-out portion 39 to form and obtain the alignment element 40 (see FIG. 10A).

Figure 5A:
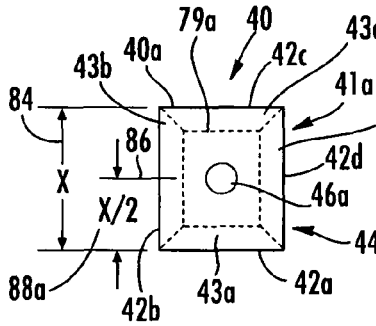
FIG. 5A shows a front plan view of an embodiment of an alignment element having a rectangle shape and showing a symmetry line measurement position at a height (x/2)

Each alignment element 40 (see FIG. 4C) further comprises a front side 58*a* (see FIG. 4C), a back side 60*a* (see FIG. 4C), a first edge 42*a* (see FIG. 5A), a second edge 42*b* (see FIG. 5A), a third edge 42*c* (see FIG. 5A), and a fourth edge 42*d* (see FIG. 5A), a first angled or beveled sidewall 43*a* (see FIG. 5A), a second angled or beveled sidewall 43*b* (see FIG. 5A), a third angled or beveled sidewall 43*c* (see FIG. 5A), and a fourth angled or beveled sidewall 43*d* (see FIG. 5A).

Although the alignment element 40 shown in the embodiment of FIG. 5A has angled sidewalls, the alignment element 40 may in another embodiment have straight sidewalls, such as shown in FIG. 10E. FIG. 10E shows an alignment element 40, such as in the form of alignment element 40*d*, having a first straight sidewall 122*a*, a second straight sidewall 122*b*, a third straight sidewall 122*c*, and a fourth straight sidewall 122*d*. In another embodiment, the alignment element 40 may have a combination of one or more angled sidewalls and one or more straight sidewalls.

The doctor blade assembly 10*a* (see FIG. 4A) further comprises a blade portion 20*a* (see FIG. 4A) attached along the first elongated positioning portion 110 (see FIG. 4A) between the pair of recessed openings 48 (see FIG. 4A). The doctor blade assembly 10*a* further comprises a pair of fastener members 16 (see FIG. 4A) each configured for insertion through the alignment through hole 46*a* (see FIG. 4A) of the alignment elements 40 and through the recessed openings 48. The fastener members 16 (see FIG. 10C) may be in the form of a screw 16*a* (see FIG. 10C), a bolt 16*b* (see FIG. 10E), or another suitable fastener member. The head of the fastener member 16 needs to be of a sufficient size so as to secure the alignment element 40 within the recessed opening 48. As shown in FIG. 10C, preferably, each fastener member 16 has a shaft length 109 greater than a thickness 111 of each alignment element 40, such as alignment element 40*a* (see FIG. 10C).

FIG. 4B shows a front perspective view of the doctor blade assembly 10*a* of FIG. 4A in a partially aligned position 64*a* in a toner hopper 56*a* of a toner printer cartridge 11. As shown in FIG. 4B, the doctor blade assembly 10*a* in the partially aligned position 64*a* shows each fastener member 16, alignment through hole 46*a*, and recessed opening 48 in a first alignment path 72*a* with each other and aligned with a positioning pin 70 in the toner hopper 56*a*. A positioning pin 70 is shown positioned at a first end 35*a* and at a second end 35*b* of the toner hopper 56*a*. The holder portion 18*a* of the doctor blade assembly 10*a* is shown in FIG. 4B positioned in the toner hopper 56*a* at first toner hopper portion 66 and at second toner hopper portion 68.

FIG. 4C shows an enlarged front perspective view of the circle 4C of FIG. 4B showing the alignment element 40, such as in the form of alignment element 40*a*, with the rectangle shape 44. As shown in FIG. 4C, the fastener member 16, alignment through hole 46*a* of the alignment element 40, and open portion 50*a* of the recessed opening 48, in the form of recessed opening 48*a*, having a rectangle shape 44, are aligned with the positioning pin 70 in the first alignment path 72*a*. The alignment element 40 and the recessed opening 48 are also aligned at a second alignment path 74*a* and a third alignment path 76*a*.

Figure 4D:
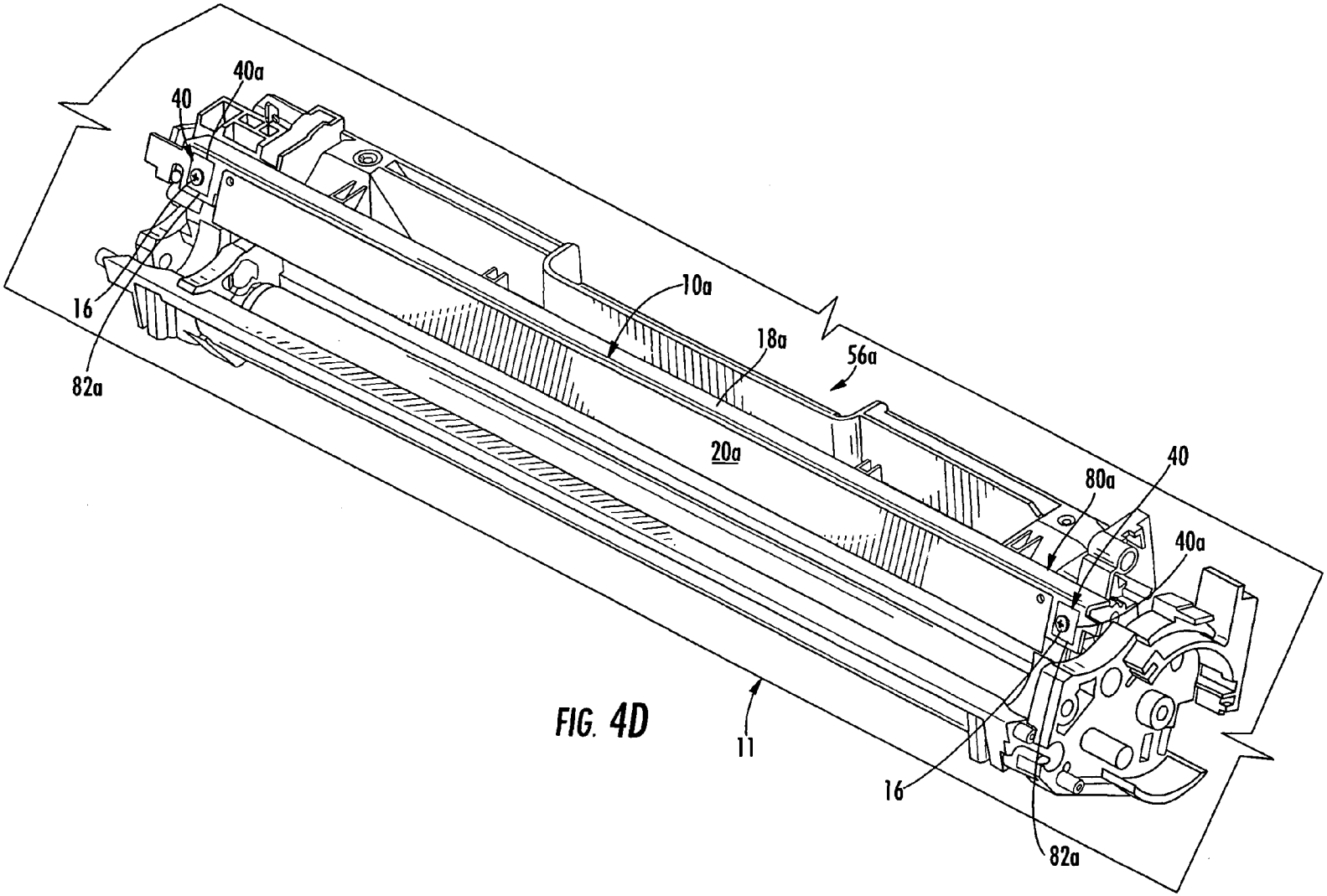
FIG. 4D shows a front perspective view of the doctor blade assembly of FIG. 4A in a desired alignment position in a toner hopper of a toner printer cartridge.

FIG. 4D shows a front perspective view of the doctor blade assembly 10*a* of FIG. 4A in a desired alignment position 80*a* where the doctor blade assembly 10*a* is fully aligned in the toner hopper 56*a* of the toner printer cartridge 11. As shown in FIG. 4D, each alignment element 40, such as in the form of alignment element 40*a*, is attached with the fastener member 16 to the holder portion 18*a* and in a fully attached position 82*a* such that the surface of the alignment element 40 is preferably flush with the surface of the first mounting end 12*a* (see FIG. 4A) and flush with the surface of the second mounting end 12*b* (see FIG. 4A) of the holder portion 18*a*. The doctor blade assembly 10*a* (see FIG. 4A) does not require use of a spacing element 36 (see FIG. 3A) or a fixture element 37 (see FIG. 3A) to align or to adjust the desired alignment position 80*a* (see FIG. 4D) of the doctor blade assembly 10*a* in the toner hopper 56*a* (see FIG. 4D) of the toner printer cartridge 11 (see FIG. 4D).

Figures 6A, 6B:
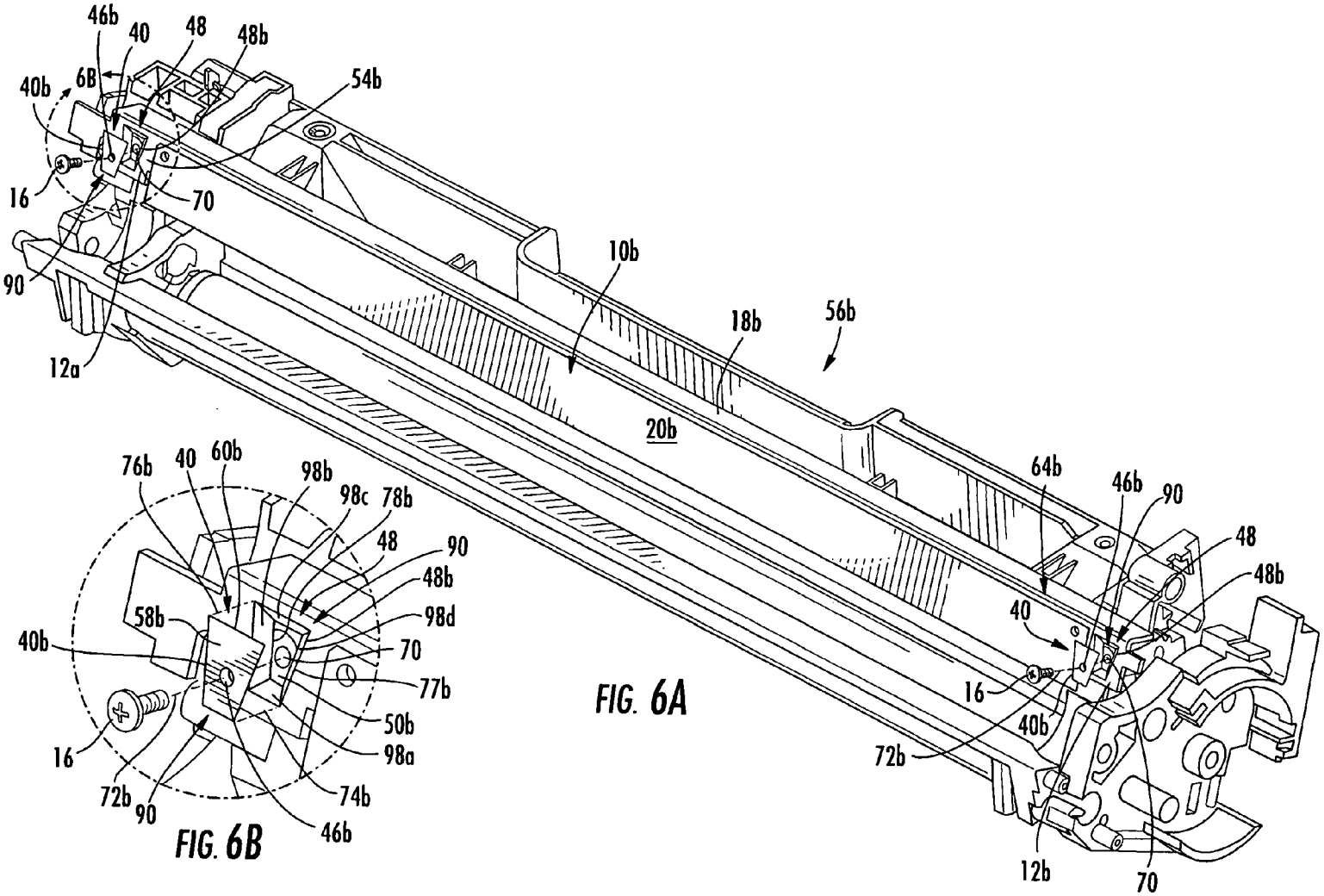
FIG. 6A shows a front perspective view of another one of the embodiments of a doctor blade assembly of the disclosure in a partially aligned position in a toner hopper and having alignment elements with a trapezoid shape.
FIG. 6B shows an enlarged front perspective view of the circle 6B of FIG. 6A showing an alignment element and a recessed opening with a trapezoid shape.

FIG. 6A shows a front perspective view of another one of the embodiments of a doctor blade assembly 10*b* of the disclosure in a partially aligned position 64*b* in a toner hopper 56*b* and having alignment elements 40, such as in the form of alignment elements 40*b*, with a trapezoid shape 90. As shown in FIG. 6A, the doctor blade assembly 10*b* comprises holder portion 18*b* having first mounting end 12*a* and second mounting end 12*b*, and further comprises blade portion 20*b*. As further shown in FIG. 6A, the holder portion 18*b* comprises a pair of recessed openings 48, such as in the form of recessed openings 48*b*, having a trapezoid shape 90, and formed at portions 54*b* in the first mounting end 12*a* and in the second mounting end 12*b*, respectively. As further shown in FIG. 6A, the doctor blade assembly 10*b* in the partially aligned position 64*b* shows each fastener member 16, alignment through hole 46*b*, and recessed opening 48 in a first alignment path 72*b* with each other, and aligned with a positioning pin 70 in the toner hopper 56*a*.

FIG. 6B shows an enlarged front perspective view of the circle 6B of FIG. 6A showing an alignment element 40, such as in the form of alignment element 40*b*, and a recessed opening 48, such as in the form of recessed opening 48*b*, both with a trapezoid shape 90. As shown in FIG. 6B, the fastener member 16, alignment through hole 46*b* of the alignment element 40, and open portion 50*b* of the recessed opening 48, are aligned with the positioning pin 70 in a first alignment path 72*b*. The alignment element 40 and the recessed opening 48 are also aligned at a second alignment path 74*b* and a third alignment path 76*b*. As further shown in FIG. 6B, the alignment element 40 further comprises a front side 58*b* and a back side 60*b*, and the recessed opening 48*b* comprises an outer profile shape 77*b*, an inner profile shape 78*b*, first angled sidewall 98*a*, a second angled sidewall 98*b*, a third angled sidewall 98*c*, and a fourth angled sidewall 98*d*.

Figure 6C:
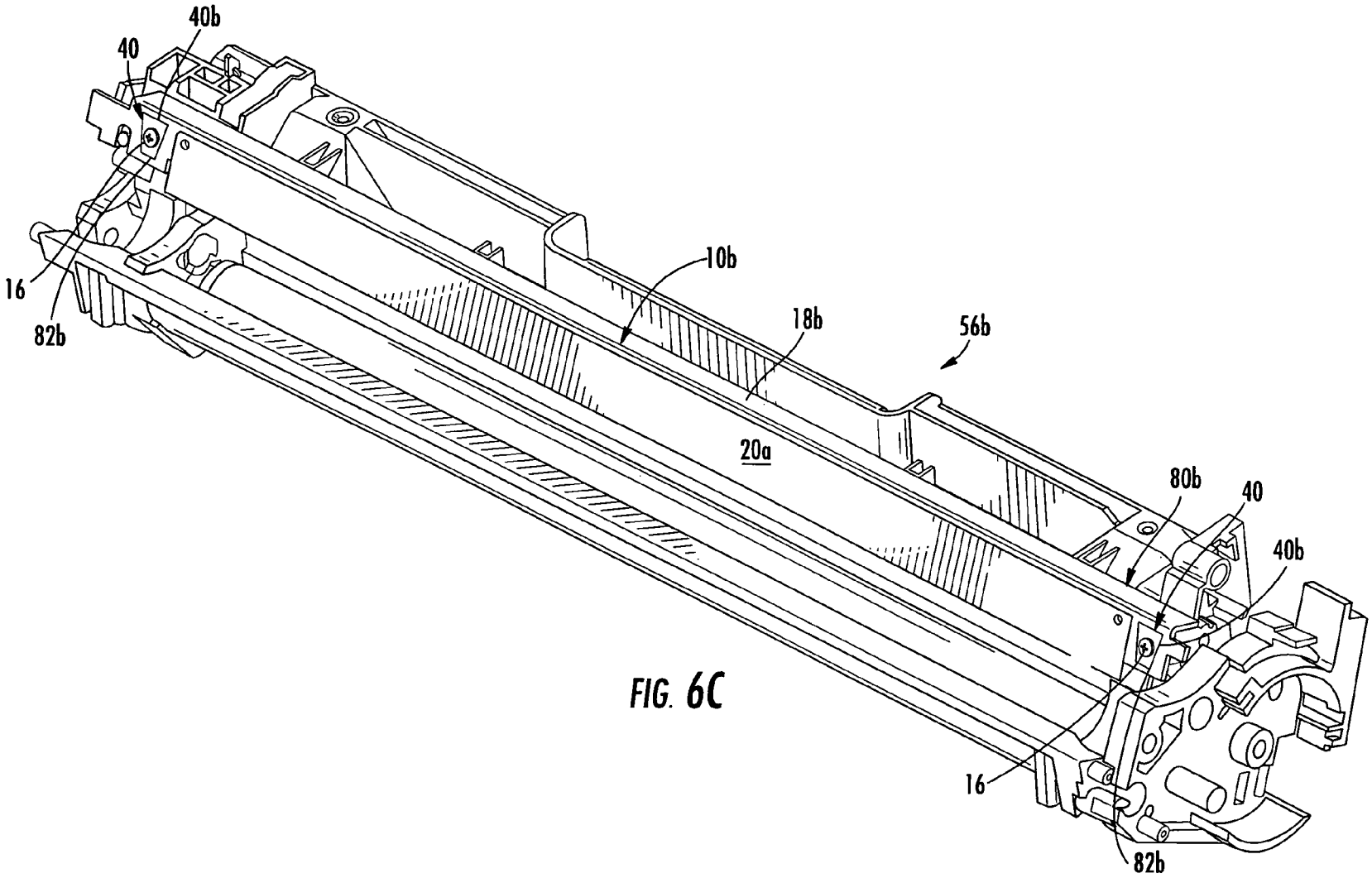
FIG. 6C shows a front perspective view of the doctor blade assembly of FIG. 6A in a desired alignment position in a toner hopper.

FIG. 6C shows a front perspective view of the doctor blade assembly 10*b* of FIG. 6A in a desired alignment position 80*b* in a toner hopper 56*b* and shows the doctor blade assembly 10*b* fully aligned in the toner hopper 56*b*. As shown in FIG. 6C, each alignment element 40, such as in the form of alignment element 40*b*, is attached with the fastener member 16 to the holder portion 18*b* and is in a fully attached position 82*b* such that the surface of the alignment element 40 is preferably flush with the surface of the first mounting end 12*a* (see FIG. 6A) and flush with the surface of the second mounting end 12*b* (see FIG. 6A) of the holder portion 18*b*. The doctor blade assembly 10*b* (see FIG. 6C) does not require use of a spacing element 36 (see FIG. 3A) or a fixture element 37 (see FIG. 3A) to align or to adjust the desired alignment position 80*b* (see FIG. 6C) of the doctor blade assembly 10*b* in the toner hopper 56*b* (see FIG. 6C) of the toner printer cartridge 11 (see FIG. 4D).

Figures 8A, 8B, 9:
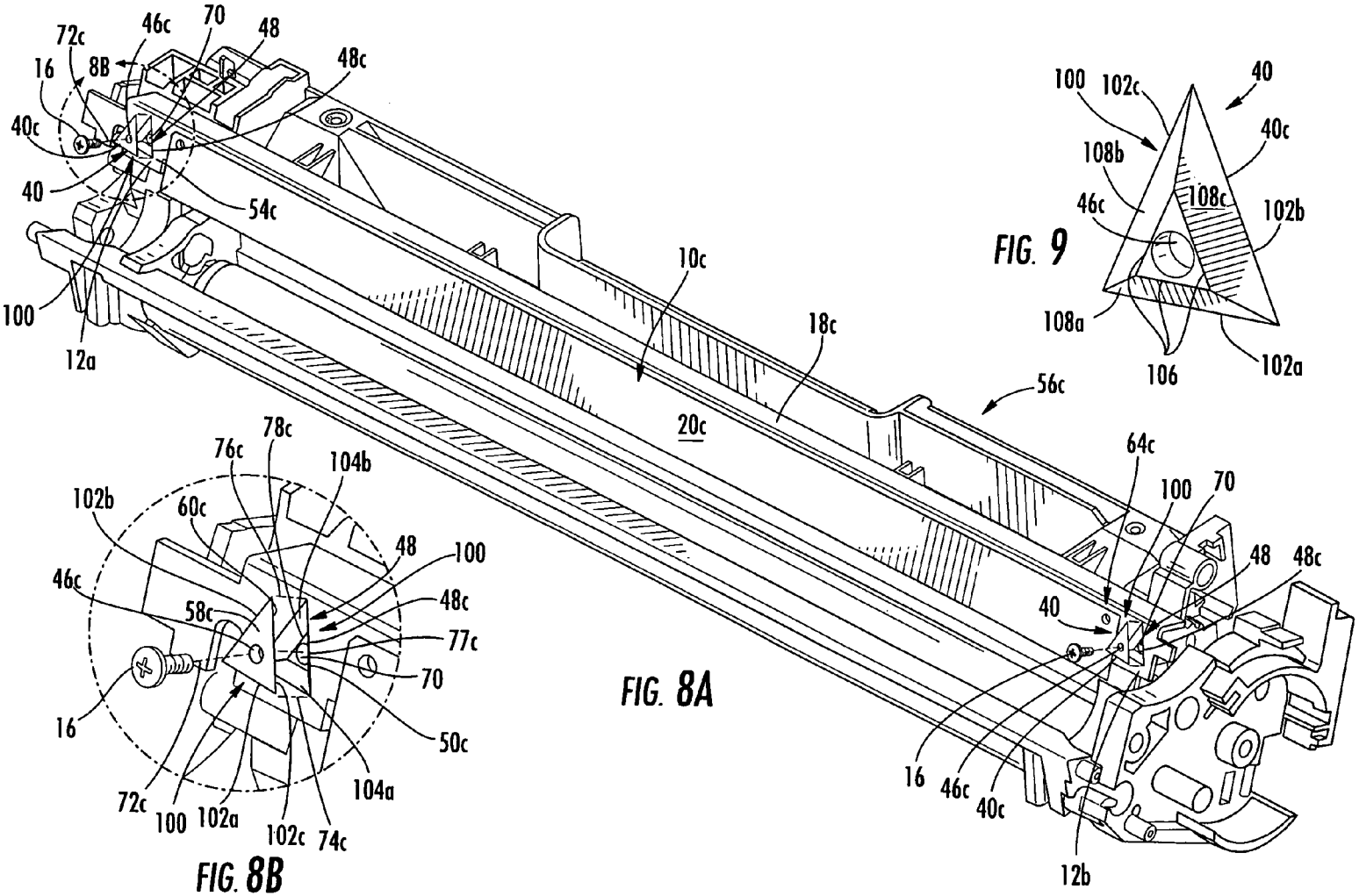
FIG. 8A shows a front perspective view of another one of the embodiments of a doctor blade assembly of the disclosure in a partially aligned position in a toner hopper and having alignment elements with a triangle shape.
FIG. 8B shows an enlarged front perspective view of the circle 8B of FIG. 8A showing an alignment element and a recessed opening with the triangle shape.
FIG. 9 shows an enlarged back perspective view of an alignment element having a triangle shape.

FIG. 8A shows a front perspective view of another one of the embodiments of a doctor blade assembly 10*c* of the disclosure in a partially aligned position 64*c* in a toner hopper 56*c* and having alignment elements 40, such as in the form of alignment elements 40*c*, with a triangle shape 100. As shown in FIG. 8A, the doctor blade assembly 10*c* comprises holder portion 18*c* having first mounting end 12*a* and second mounting end 12*b*, and further comprises blade portion 20*c*. As further shown in FIG. 8A, the holder portion 18*c* comprises a pair of recessed openings 48, such as in the form of recessed openings 48*c*, having a trapezoid shape 90, and formed at portions 54*c* in the first mounting end 12*a* and in the second mounting end 12*b*, respectively. As further shown in FIG. 8A, the doctor blade assembly 10*c* in the partially aligned position 64*c* shows each fastener member 16, alignment through hole 46*c*, and recessed opening 48 in a first alignment path 72*c* (see FIG. 8B) with each other, and aligned with a positioning pin 70 in the toner hopper 56*c*.

FIG. 8B shows an enlarged front perspective view of the circle 8B of FIG. 8A showing an alignment element 40, such as in the form of alignment element 40*c*, and a recessed opening 48, such as in the form of recessed opening 48*c*, both with a triangle shape 100. As shown in FIG. 8B, the fastener member 16, alignment through hole 46*c* of the alignment element 40, and open portion 50*c* of the recessed opening 48, are aligned with the positioning pin 70 in a first alignment path 72*c*. The alignment element 40 and the recessed opening 48 are also aligned at a second alignment path 74*c* and a third alignment path 76*c*. As further shown in FIG. 8B, the alignment element 40 further comprises a front side 58*c* and a back side 60*c*, and the recessed opening 48*c* comprises an outer profile shape 77*c*, an inner profile shape 78*c*, first angled sidewall 104*a*, a second angled sidewall 104*b*, and a third angled sidewall 104*c*.

Figure 8C:
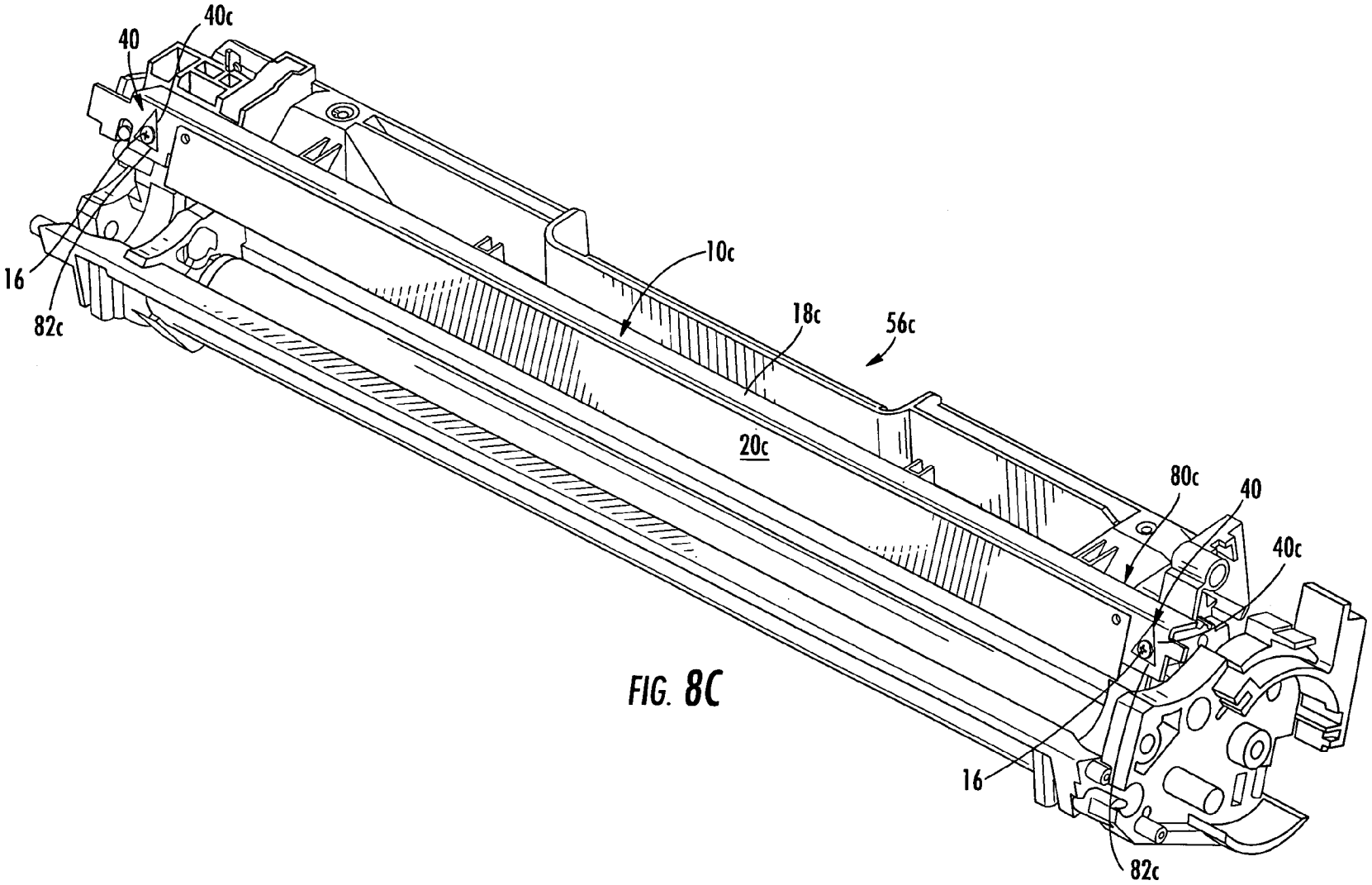
FIG. 8C shows a front perspective view of the doctor blade assembly of FIG. 8A in a desired alignment position in a toner hopper.

FIG. 8C shows a front perspective view of the doctor blade assembly 10*c* of FIG. 8A in a desired alignment position 80*c* in a toner hopper 56*c* and shows the doctor blade assembly 10*c* fully aligned in the toner hopper 56*c*. As shown in FIG. 8C, each alignment element 40, such as in the form of alignment element 40*c*, is attached with the fastener member 16 to the holder portion 18*b* and is in a fully attached position 82*c* such that the surface of the alignment element 40 is preferably flush with the surface of the first mounting end 12*a* (see FIG. 8A) and flush with the surface of the second mounting end 12*b* (see FIG. 8A) of the holder portion 18*c*. The doctor blade assembly 10*c* (see FIG. 8C) does not require use of a spacing element 36 (see FIG. 3A) or a fixture element 37 (see FIG. 3A) to align or to adjust the desired alignment position 80*c* (see FIG. 8C) of the doctor blade assembly 10*c* in the toner hopper 56*c* (see FIG. 8C) of the toner printer cartridge 11 (see FIG. 4D).

FIG. 9 shows an enlarged back perspective view of the alignment element 40, such as in the form of alignment element 40*c*, having a triangle shape 100. As shown in FIG. 9, the alignment element 40*c* shows first outer edge 102*a*, second outer edge 102*b*, third outer edge 102*c*, inner edges 106, and first angled or beveled sidewall 108*a*, second angled or beveled sidewall 108*b*, and third angled or beveled sidewall 108*c*.

FIG. 5A shows a front plan view of an embodiment of an alignment element 40, such as in the form of alignment element 40*a*, having a rectangle shape 44, having a height (x) 84 measured from a first edge 42*a* to *a* third edge 42*c*, and having a predetermined alignment position 41*a*. FIG. 5A further shows a symmetry line measurement position 86 at a height (x/2) 88*a* used in determining the predetermined alignment position 41*a* of the alignment through hole 46*a*. FIG. 5A further shows a second edge 42*b*, a fourth edge 42*d*, an inner profile 79*a*, a first angled or beveled sidewall 43*a*, a second angled or beveled sidewall 43*b*, a third angled or beveled sidewall 43*c*, and a fourth angled or beveled sidewall 43*d*.

Figure 5B:
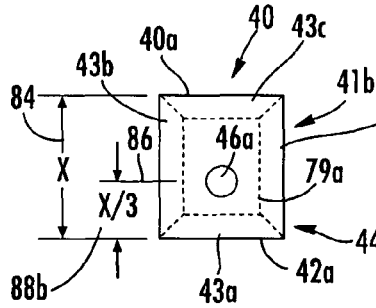
FIG. 5B shows a front plan view of another embodiment of an alignment element having a rectangle shape and showing a symmetry line measurement position at a height (x/3)

FIG. 5B shows a front plan view of another embodiment of an alignment element 40, such as in the form of alignment element 40*a*, having a rectangle shape 44, having a height (x) 84, and having a predetermined alignment position 41*b*. FIG. 5B further shows a symmetry line measurement position 86 at a height (x/3) 88*b* used in determining the predetermined alignment position 41*b* of the alignment through hole 46*a*. FIG. 5B further shows an inner profile 79*a*, a first angled or beveled sidewall 43*a*, a second angled or beveled sidewall 43*b*, a third angled or beveled sidewall 43*c*, and a fourth angled or beveled sidewall 43*d*.

Figure 5C:
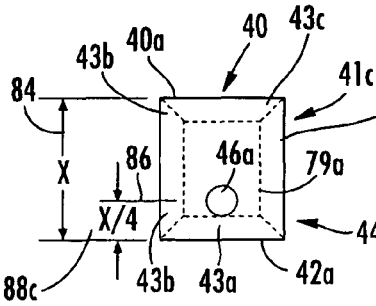
FIG. 5C shows a front plan view of another embodiment of an alignment element having a rectangle shape and showing a symmetry line measurement position at a height (x/4)

FIG. 5C shows a front plan view of another embodiment of an alignment element 40, such as in the form of alignment element 40*a*, having a rectangle shape 44, having a height (x) 84, and having a predetermined alignment position 41*c*. FIG. 5C further shows a symmetry line measurement position 86 at a height (x/4) 88*c* used in determining the predetermined alignment position 41*c* of the alignment through hole 46*a*. FIG. 5C further shows an inner profile 79*a*, a first edge 42*a*, a first angled or beveled sidewall 43*a*, a second angled or beveled sidewall 43*b*, a third angled or beveled sidewall 43*c*, and a fourth angled or beveled sidewall 43*d*.

Figure 7A:
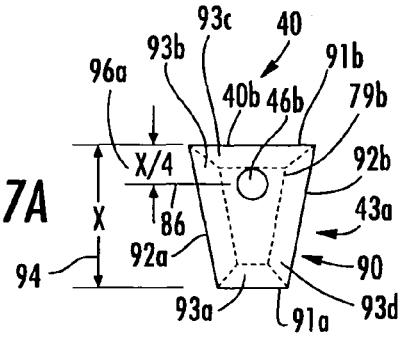
FIG. 7A shows a front plan view of an embodiment of an alignment element having a trapezoid shape and showing a symmetry line measurement position at a first height (x/4)

FIG. 7A shows a front plan view of an embodiment of an alignment element 40, such as in the form of alignment element 40*b*, having a trapezoid shape 90, having a height (x) 94 measured from a first untapered edge 91*a* to a second untapered edge 91*b*, and having a predetermined alignment position 43*a*. FIG. 7A further shows a symmetry line measurement position 86 at a first height (x/4) 96*a* used in determining the predetermined alignment position 43*a* of the alignment through hole 46*b*. FIG. 7A further shows a first tapered edge 92*a*, a second tapered edge 92*b*, an inner profile 79*b*, a first angled or beveled sidewall 93*a*, a second angled or beveled sidewall 93*b*, a third angled or beveled sidewall 93*c*, and a fourth angled or beveled sidewall 93*d*.

Figure 7B:
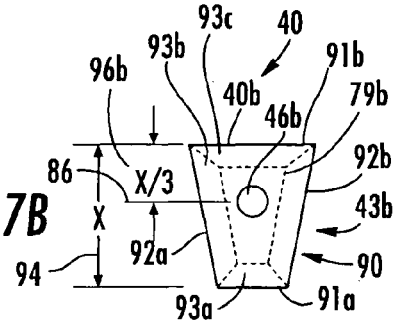
FIG. 7B shows a front plan view of another embodiment of an alignment element having a trapezoid shape and showing a symmetry line measurement position at a first height (x/3)

FIG. 7B shows a front plan view of an embodiment of an alignment element 40, such as in the form of alignment element 40*b*, having a trapezoid shape 90, having a height (x) 94 measured from the first untapered edge 91*a* to the second untapered edge 91*b*, and having a predetermined alignment position 43*b*. FIG. 7B further shows a symmetry line measurement position 86 at a first height (x/3) 96*b* used in determining the predetermined alignment position 43*b* of the alignment through hole 46*b*. FIG. 7B further shows a first tapered edge 92*a*, a second tapered edge 92*b*, an inner profile 79*b*, a first angled or beveled sidewall 93*a*, a second angled or beveled sidewall 93*b*, and a third angled or beveled sidewall 93*c*.

Figure 7C:
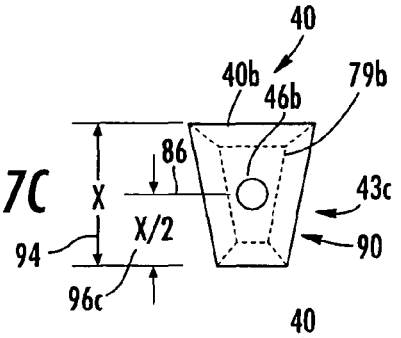
FIG. 7C shows a front plan view of another embodiment of an alignment element having a trapezoid shape and showing a symmetry line measurement position at an height (x/2)

FIG. 7C shows a front plan view of an embodiment of an alignment element 40, such as in the form of alignment element 40*b*, having a trapezoid shape 90, having a height (x) 94, and having a predetermined alignment position 43*c*. FIG. 7C further shows a symmetry line measurement position 86 at a height (x/2) 96*c* used in determining the predetermined alignment position 43*c* of the alignment through hole 46*b*. FIG. 7C further shows an inner profile 79*b*.

Figure 7D:
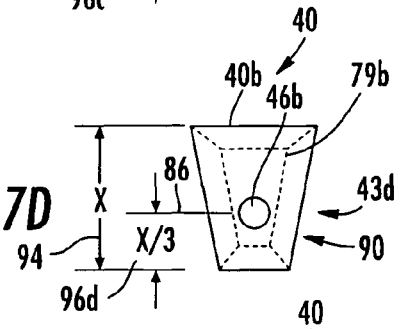
FIG. 7D shows a front plan view of another embodiment of an alignment element having a trapezoid shape and showing a symmetry line measurement position at a second height (x/3)

FIG. 7D shows a front plan view of an embodiment of an alignment element 40, such as in the form of alignment element 40*b*, having a trapezoid shape 90, having a height (x) 94, and having a predetermined alignment position 43*d*. FIG. 7D further shows a symmetry line measurement position 86 at a second height (x/3) 96*d* used in determining the predetermined alignment position 43*d* of the alignment through hole 46*b*. FIG. 7C further shows an inner profile 79*b*.

Figure 7E:
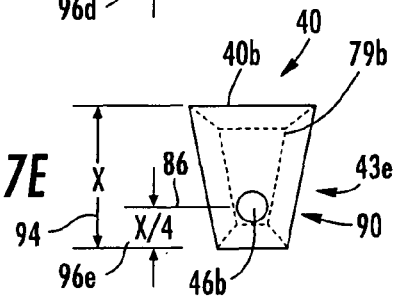
FIG. 7E shows a front plan view of another embodiment of an alignment element having a trapezoid shape and showing a symmetry line measurement position at a second height (x/4)

FIG. 7E shows a front plan view of an embodiment of an alignment element 40, such as in the form of alignment element 40*b*, having a trapezoid shape 90, having a height (x) 94, and having a predetermined alignment position 43*e*. FIG. 7E further shows a symmetry line measurement position 86 at a second height (x/4) 96*e* used in determining the predetermined alignment position 43*e* of the alignment through hole 46*b*. FIG. 7C further shows an inner profile 79*b*.

Figure 10A:
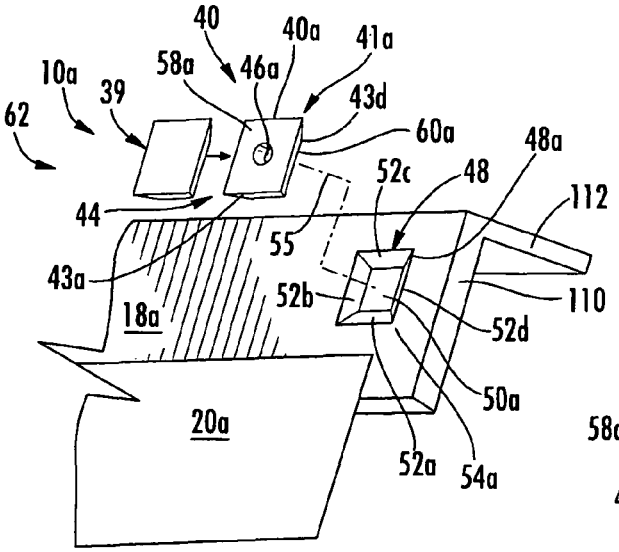
FIG. 10A shows an enlarged partial front perspective view of an embodiment of the doctor blade assembly in a non-aligned position and showing a cut-out portion prior to being formed into an alignment element.

FIG. 10A shows an enlarged partial front perspective view of an embodiment of the doctor blade assembly 10*a* in a pre-aligned position 62 and showing a cut-out portion 39 prior to being formed into an alignment element 40, such as in the form of alignment element 40*a*, having a rectangle shape 44, and having an alignment through hole 46*a* formed in the alignment element 40. FIG. 10A further shows the alignment element 40 having the predetermined alignment position 41*a*, having the first angled or beveled sidewall 43*a*, the second angled or beveled sidewall 43*b*, the third angled or beveled sidewall 43*c*, and the fourth angled or beveled sidewall 43*d*. FIG. 10A further shows the insertion and removal path 55 from the alignment element 40 to the recessed opening 48, such as in the form of recessed opening 48*a*, having a rectangle shape. As shown in FIG. 10A, the recessed opening 48 has open portion 50*a*, and first angled sidewall 52*a*, second angled sidewall 52*b*, third angled sidewall 52*c*, and fourth angled sidewall 52*d*.

Figure 10B:
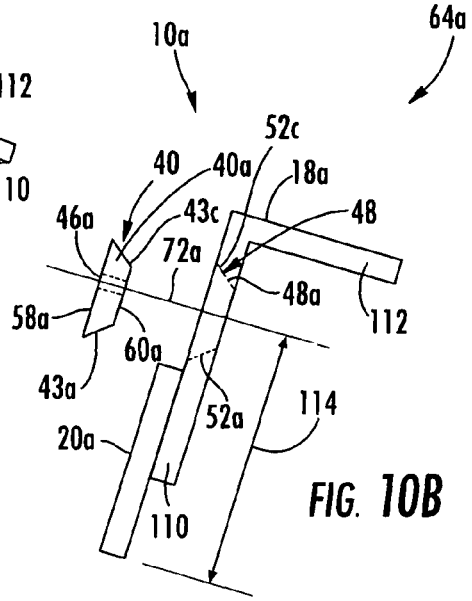
FIG. 10B shows a right side view of the doctor blade assembly of FIG. 10A in a partially aligned position.
Figure 10C:
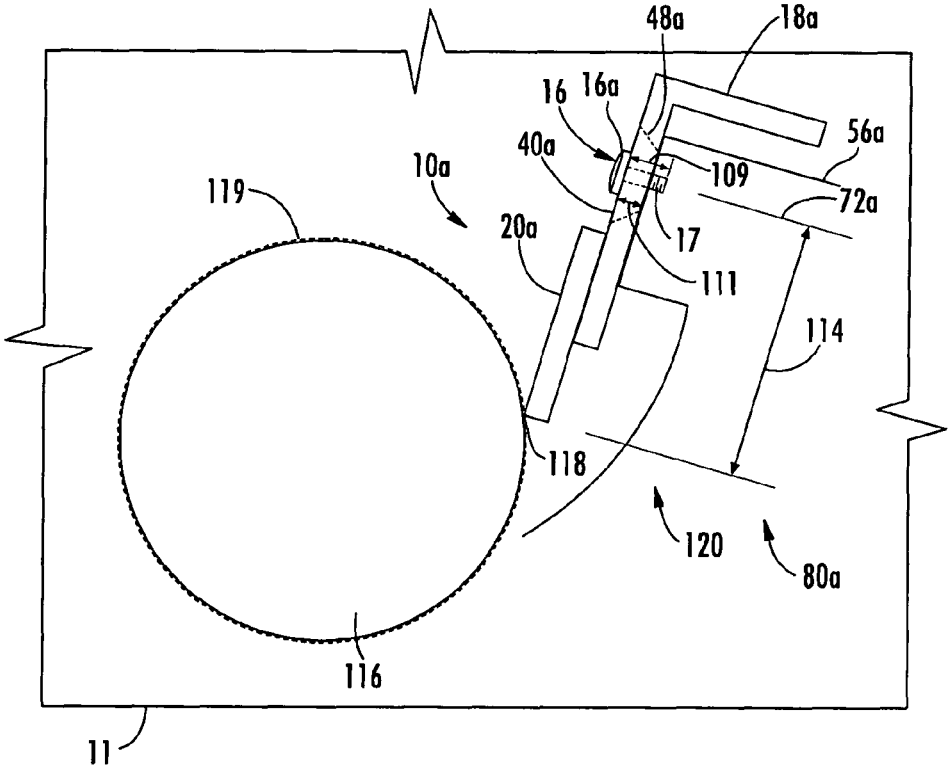
FIG. 10C shows a right side view of the doctor blade assembly of FIG. 10B in a desired alignment position in contact with a developer roller and aligned in a toner hopper in a toner printer cartridge.

FIG. 10B shows a right side view of the doctor blade assembly 10*a* of FIG. 10A in a partially aligned position 64*a*. As shown in FIG. 10B, the alignment element 40, such as in the form of alignment element 40*a*, has a front side 58*a*, a back side 60*a*, and an alignment through hole 46*a*. The alignment element 40 is aligned along first alignment path 72*a* through the recessed opening 48, such as in the form of recessed opening 48*a*. FIG. 10B further shows first angled sidewall 52*a* and third angled sidewall 52*c*, formed in the first elongated positioning portion 110 of holder portion 18*a*. The blade portion 20*a* is shown adjacent the first elongated positioning portion 110 and a height 114 from the bottom of the blade portion 20*a* to the first alignment path 72*a* is important in determining where the alignment through hole 46*a* is positioned through the alignment element 40.

FIG. 10C shows a right side view of the doctor blade assembly 10*a* of FIG. 10B in a desired alignment position 80*a* in contact with a developer roller 116 and aligned in a toner hopper 56*a* in a toner printer cartridge 11. FIG. 10C shows the fastener member 16, such as in the form of screw 16*a*, inserted through the alignment element 40*a* and through the recessed opening 48*a*. Preferably, the fastener member 16 has a shaft length 109 greater than a thickness 111 of the alignment element 40*a* and the recessed opening 48*a*. As further shown in FIG. 10C, when the alignment element 40*a* is aligned and inserted within the corresponding recessed opening 48*a* at the desired alignment position 80*a*, the doctor blade assembly 10*a* is in a set position 120 with respect to the developer roller 116, so that the blade portion 20*a* contacts the developer roller 116 at desired contact location 118 to regulate the amount of toner 119 on the developer roller 116 and to give charge to the toner 119.

Figure 10D:
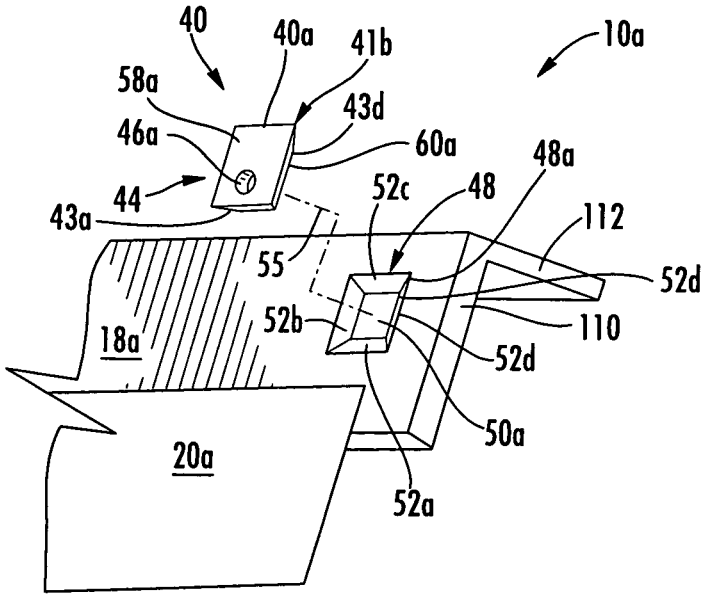
FIG. 10D shows an enlarged partial front perspective view of another embodiment of the doctor blade assembly in a nonaligned position with another embodiment of an alignment through hole.
Figure 10E:
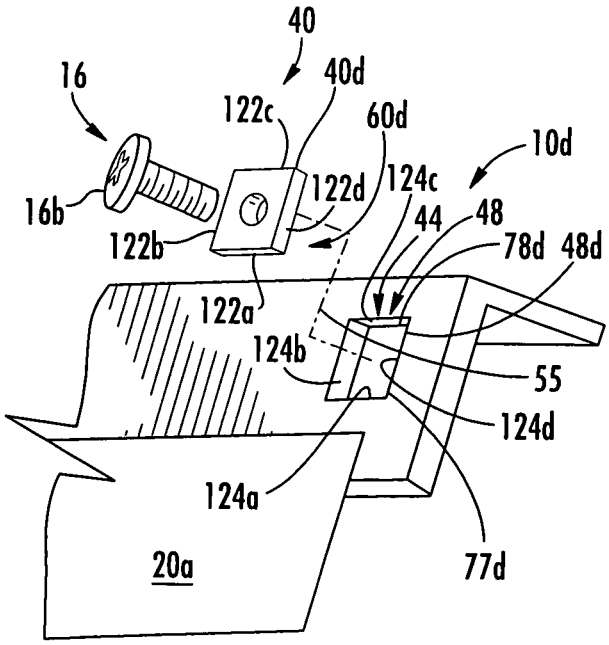
FIG. 10E shows an enlarged front perspective view of another embodiment of the doctor blade assembly of the disclosure in a nonaligned position and having an alignment element and a recessed opening with straight sidewalls; and, FIG. 11 shows an illustration of a flow diagram of an embodiment of a method of the disclosure.

FIG. 10D shows an enlarged partial front perspective view of another embodiment of the doctor blade assembly 10*a* before it is aligned and showing the alignment element 40, such as in the form of alignment element 40*a*, having a rectangle shape 44, and having an alignment through hole 46*a* formed in the alignment element 40 and formed through the first elongated positioning portion 110 of the holder portion 18*a*. FIG. 10D further shows the alignment element 40 having the predetermined alignment position 41*b*, having the front side 58*a*, the back side 60*a*, the first angled or beveled sidewall 43*a*, the second angled or beveled sidewall 43*b*, the third angled or beveled sidewall 43*c*, and the fourth angled or beveled sidewall 43*d*. FIG. 10D further shows the insertion and removal path 55 from the alignment element 40 to the recessed opening 48, such as in the form of recessed opening 48*a*, having a rectangle shape. As shown in FIG. 10D, the recessed opening 48 has open portion 50*a*, and first angled sidewall 52*a*, second angled sidewall 52*b*, third angled sidewall 52*c*, and fourth angled sidewall 52*d*.

FIG. 10E shows an enlarged front perspective view of another embodiment of a doctor blade assembly 10*d* of the disclosure before it is aligned and showing the alignment element 40, such as in the form of alignment element 40*d*, having a rectangle shape 44, having a larger alignment through hole formed in the alignment element 40, and having straight sidewalls, including first straight sidewall 122*a*, second straight sidewall 122*b*, third straight sidewall 122*c*, and fourth straight sidewall 122*d*. As shown in FIG. 10E, this embodiment requires a sufficiently large fastener member 16, such as in the form of bolt 16*b*, that needs to be sufficiently large enough to secure the alignment element 40 within the recessed opening 48, such as recessed opening 48*d*, having a rectangle shape 44. FIG. 10E further shows the recessed opening 48 having an outer profile shape 77*d*, an inner profile shape 78*d*, the first straight sidewall 124*a*, the second straight sidewall 124*b*, the third straight sidewall 124*c*, and the fourth straight sidewall 124*d*. FIG. 10E further shows the insertion and removal path 55 from the alignment element 40 to the recessed opening 48.

There is provided in another embodiment a toner printer cartridge 11 (see FIG. 4B). The toner printer cartridge 11 (see FIG. 4B) comprises a toner hopper 56*a* (see FIG. 4BD). The toner printer cartridge 11 further comprises a doctor blade assembly 10*a* (see FIG. 4B) for alignment on the toner hopper 56*a*. The doctor blade assembly 10*a* comprises a holder portion 18*a* (see FIG. 4B). The holder portion 18*a* comprises a first elongated positioning portion 110 (see FIG. 4A) having a first mounting end 12*a* (see FIG. 4A) and a second mounting end 12*b* (see FIG. 4A), a second elongated positioning portion 112 (see FIG. 4A) substantially perpendicular to the first elongated positioning portion 110 (see FIG. 4A), a pair of recessed openings 48 (see FIG. 4A) formed in the first mounting end 12*a* and the second mounting end 12*b*, respectively, a pair of alignment elements 40 (see FIG. 4A) each having an alignment through hole 46*a* (see FIG. 4A) and each configured to fit in and correspond to each respective recessed opening 48. Each alignment element 40*a*, 40*b*, 40*c* and each recessed opening 48*a*, 48*b*, 48*c* has a corresponding outer profile in a shape including a rectangle shape 44 (see FIG. 4B), a trapezoid shape 90 (see FIG. 6A), a triangle shape 100 (see FIG. 8A),), a square shape (not shown), a pentagon shape (not shown), a hexagon shape (not shown), a circle shape (not shown), an oval shape (not shown), or another suitable shape. Each alignment element 40 has a plurality of angled sidewalls or a plurality of straight sidewalls. The doctor blade assembly 10*a* (see FIG. 4A) further comprises a blade portion 20*a* (see FIG. 4A) attached along the first elongated positioning portion 110 (see FIG. 4A) between the pair of recessed openings 48 (see FIG. 4A). The doctor blade assembly 10*a* (see FIG. 4A) further comprises a pair of fastener members 16 (see FIG. 4A) each configured for insertion through the alignment through hole 46*a* (see FIG. 4A) of the alignment elements 40 (see FIG. 4A) and through the recessed openings 48 (see FIG. 4A). The doctor blade assembly 10*a* (see FIG. 4A) does not require use of a spacing element 36 (see FIG. 3A) or a fixture element 37 (see FIG. 3A) to align or to adjust the doctor blade assembly 10*a* position in the toner hopper 56*a* (see FIG. 4B) of the toner printer cartridge 11 (see FIG. 4A).

Figure 11:
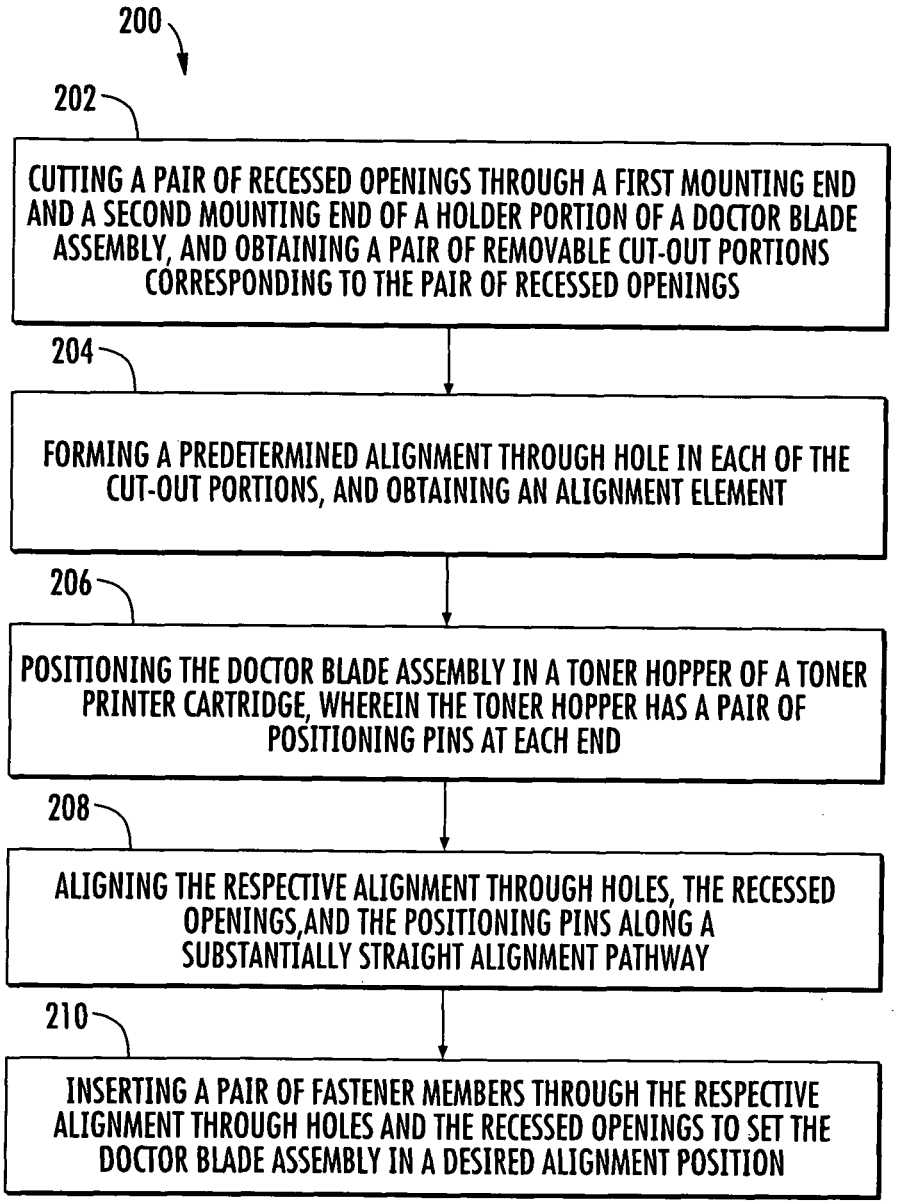

There is provided in another embodiment a method 200 (see FIG. 11) for aligning a doctor blade assembly 10*a* (see FIG. 4A) in a toner hopper 56*a* (see FIG. 4B) of a toner printer cartridge 11 (see FIG. 4B). FIG. 11 shows an illustration of a flow diagram of an embodiment of the method 200 of the disclosure. The method 200 comprises step 202 of cutting a pair of recessed openings 48 (see FIGS. 4A, 10A) through a first mounting end 12*a* (see FIG. 4A) and a second mounting end 12*b* (see FIG. 4A) of a holder portion 18*a* (see FIG. 4A) of a doctor blade assembly 10*a* (see FIG. 4A), and obtaining a pair of removable cut-out portions 39 (see FIG. 10A) corresponding to the pair of recessed openings 48 (see FIG. 4A). The cutting step 202 may be performed with a known cutting process comprising a laser cutting process, a drilling process, a plasma arc cutting process, a water jet cutting process, an oxyfuel cutting process, a die cutting process, an etch cutting process, or another suitable known cutting process. The cutting step 202 may comprise cutting a plurality of angled sidewalls 52 (see FIG. 4A) for each recessed opening 48 (see FIG. 4A), cutting a plurality of straight sidewalls 124*a*, 124*b*, 124*c*, 124*d* (see FIG. 10E) for each recessed opening 48 (see FIG. 10E), or cutting a combination of one or more angled sidewalls 52 (see FIG. 4C) and one or more straight sidewalls 124*a*, 124*b*, 124*c*, 124*d* (see FIG. 10E). Each recessed opening 48 and each alignment element 40 preferably have the same number or plurality of angled sidewalls, straight sidewalls, or combination of angled sidewalls and straight sidewalls. The cutting step 202 preferably comprises cutting an outer profile 77*a* (see FIG. 4C) of each recessed opening 48 (see FIG. 4C) in a shape including a rectangle shape 44 (see FIG. 4B), a trapezoid shape 90 (see FIG. 6A), a triangle shape 100 (see FIG. 8A),), a square shape (not shown), a pentagon shape (not shown), a hexagon shape (not shown), a circle shape (not shown), an oval shape (not shown), or another suitable shape.

As shown in FIG. 11, the method 200 further comprises step 204 of forming a predetermined alignment through hole 46*a* (see FIGS. 4A, 10A) in each of the cut-out portions 39 (see FIG. 10A), and obtaining an alignment element 40*a* (see FIGS. 4A, 10A). The forming step 204 preferably comprises forming the alignment through hole 46*a* (see FIGS. 5A-5C and 7A-7E) at a location in the alignment element 40 (see FIGS. 5A-5C and 7A-7E) based on a determination of a symmetry line measurement position 86 (see FIGS. 5A-5C and 7A-7E) including a height measurement 84 (see FIGS. 5A-5C) or a height measurement 94 (see FIGS. 7A-7E) of the alignment element 40 divided by two (x/2) (see FIGS. 5A, 7C), a height measurement 84 (see FIG. 5B) or a height measurement 94 (see FIGS. 7B, 7D) of the alignment element 40 divided by three (x/3) (see FIGS. 5B, 7B, 7D), or a height measurement 84 (see FIG. 5C) or a height measurement 94 (see FIGS. 7A, 7E) of the alignment element 40 divided by four (x/4) (see FIGS. 5C, 7A, 7E).

As shown in FIG. 11, the method 200 further comprises step 206 of positioning the doctor blade assembly 10*a* (see FIG. 4B) in a toner hopper 56*a* (see FIG. 4B) of a toner printer cartridge 11 (see FIG. 4B), wherein the toner hopper 56*a* has a pair of positioning pins 70 (see FIGS. 4B, 4C) at each end 35*a*, 35*b* (see FIG. 4B) of the toner hopper 56*a*.

As shown in FIG. 11, the method 200 further comprises step 208 of aligning the respective alignment through holes 46*a* (see FIG. 4B), the recessed openings 48 (see FIG. 4B), and the positioning pins 70 (see FIG. 4B) along a substantially straight alignment pathway 72*a* (see FIGS. 4B, 4C). The positioning step 206 and the aligning step 208 do not require use of a spacing element 36 (see FIG. 3A) or a fixture element 37 (see FIG. 3A) to adjust a desired alignment position 80*a* (see FIG. 4D) of the doctor blade assembly 10*a* (see FIG. 4D) on the toner hopper 34 (see FIG. 4D) of the toner printer cartridge 11 (see FIG. 4D).

As shown in FIG. 11, the method 200 further comprises step 210 of inserting a pair of fastener members 16 (see FIGS. 4B-4C) through the respective alignment through holes 46*a* (see FIG. 4B) and the recessed openings 48 (see FIG. 4B) to set the doctor blade assembly 10*a* (see FIG. 4D) at a desired alignment position 80*a* (see FIG. 4D). The inserting step 210 preferably comprises inserting each fastener member 16 (see FIGS. 4B-4C and FIG. 10C) having a shaft length 109 (see FIG. 10C) greater than a thickness 111 (see FIG. 10C) of each alignment element 40 and each recessed opening 48 (see FIG. 10C). The shaft length 109 must be long enough to fasten the doctor blade assembly 10*a* to the toner printer cartridge 11.

The alignment element 40 (see FIG. 4A) is designed to prevent misalignment of the doctor blade assembly 10*a* in the toner hopper 56*a* (see FIG. 4D). The doctor blade assembly 10*a* and method 200 may be used to prepare alignment elements 40 for testing and test various doctor blade assemblies 10*a* with various alignment element 40 positions. The doctor blade assembly 10*a* and method 200 may be used to test various combinations of the alignment element 40 and the blade portion 20*a* (see FIG. 4A) to find out the optimal position for the blade portion 20*a* and the doctor blade assembly 10*a*. In addition, doctor blade assembly 10*a* and method 200 enable easy adjustment when various toners with different characteristics are used.

It can now be realized that the doctor blade assembly 10*a* (see FIG. 4A), 10*b* (see FIG. 6A), 10*c* (see FIG. 8A), and method 200 (see FIG. 11) disclosed herein provide numerous advantages over known devices and methods, including but not limited to the following: provides an assembly and method that that effectively aligns and positions the doctor blade assembly with respect to the toner hopper and proximate to the developer roller (or mag roller) during assembly, manufacture, and remanufacture, which may be beneficial in allowing the doctor blade assembly to regulate the toner amount on the developer roller (or mag roller), and which may result in maximizing print quality during printing; provides a device and method that does not require the use of permanently attached spacing elements or spacers, inserts, shims, or other spacing elements and does not require the use of fixture elements to hold the doctor blade assembly, both which may increase the overall cost and complexity and decrease the overall efficiency of the assembly, manufacturing, or remanufacturing processes; provides an assembly and method that aligns and positions a doctor blade within a toner hopper or a portion of a remanufactured toner printer cartridge to maximize printing quality of the remanufactured toner printer cartridge when it is in use with a laser printer device (not shown); provides an assembly and method that aligns and positions the doctor blade during replacement and remanufacture accurately and efficiently to an acceptable alignment or position point to maximize print quality during printing; provides an assembly and method that may only require a one time setting to set a doctor blade alignment setting, thus increasing efficiency and decreasing cost; provides an assembly and method having a unique cut-out alignment element designed to prevent misalignment, and makes alignment of the doctor blade assembly easier and more reproducible; and, provides an assembly and method for aligning a doctor blade assembly in a desired position to regulate the developer layer on a developer roller in the toner printer cartridge, process cartridge or image forming device or apparatus.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. The invention is not limited in its application to the details of the construction and to the arrangement of the components set forth in the above description or as illustrated in the drawings.

What is claimed is:

1. A doctor blade assembly for alignment in a toner hopper of a toner printer cartridge, the doctor blade assembly comprising:

a holder portion comprising:

a first mounting end and a second mounting end;

a pair of recessed openings formed in the first mounting end and the second mounting end, respectively;

a pair of alignment elements each having an alignment through hole and each configured to fit in and correspond to each respective recessed opening;

a first elongated positioning portion and a second elongated positioning portion substantially perpendicular to the first elongated positioning portion, the first elongated positioning portion having the first mounting end and the second mounting end;

a blade portion attached to the holder portion, wherein the blade portion is attached along the first elongated positioning portion between the pair of recessed openings; and, a pair of fastener members each configured for insertion through the alignment through hole and through the recessed opening.

2. The doctor blade assembly of claim 1 wherein each recessed opening and each alignment element have a same plurality of angled sidewalls.

3. The doctor blade assembly of claim 1 wherein each recessed opening and each alignment element have a same plurality of straight sidewalls.

4. The doctor blade assembly of claim 1 wherein each recessed opening and each alignment element have a same outer profile in a shape selected from a group consisting of a rectangle, a trapezoid, a triangle, a square, a pentagon, a hexagon, a circle, and an oval.

5. The doctor blade assembly of claim 1 wherein each fastener member has a length greater than a thickness of each alignment element.

6. The doctor blade assembly of claim 1 wherein the alignment through hole is formed in the alignment element at a symmetry line measurement position selected from a group consisting of a height measurement of the alignment element divided by two, a height measurement of the alignment element divided by three, and a height measurement of the alignment element divided by four.

7. The doctor blade assembly of claim 1 wherein the doctor blade assembly does not require use of a spacing element or a fixture element to align or to adjust a desired alignment position of the doctor blade assembly in the toner hopper of the toner printer cartridge.

8. A toner printer cartridge comprising:

a toner hopper; and, a doctor blade assembly for alignment in the toner hopper, the doctor blade assembly comprising:

a holder portion comprising:

a first elongated positioning portion having a first mounting end and a second mounting end;

a second elongated positioning portion substantially perpendicular to the first elongated positioning portion;

a pair of recessed openings formed in the first mounting end and the second mounting end, respectively;

a pair of alignment elements each having an alignment through hole and each configured to fit in and correspond to each respective recessed opening;

a blade portion attached along the first elongated positioning portion between the pair of recessed openings; and, a pair of fastener members each configured for insertion through the alignment through hole of the alignment elements and through the recessed openings, wherein the doctor blade assembly does not require use of a spacing element or a fixture element to align or to adjust a desired alignment position of the doctor blade assembly in the toner hopper of the toner printer cartridge.

9. The toner printer cartridge of claim 8 wherein each alignment element and each recessed opening have a corresponding outer profile in a shape selected from a group consisting of a rectangle, a trapezoid, a triangle, a rectangle, a trapezoid, a triangle, a square, a pentagon, a hexagon, a circle, and an oval.

10. The toner printer cartridge of claim 8 wherein each alignment element has a plurality of angled sidewalls or a plurality of straight sidewalls.

11. A method for aligning a doctor blade assembly in a toner hopper of a toner printer cartridge, the method comprising the steps of:

cutting a pair of recessed openings through a first mounting end and a second mounting end of a holder portion of a doctor blade assembly, and obtaining a pair of removable cut-out portions corresponding to the pair of recessed openings;

forming a predetermined alignment through hole in each of the cut-out portions, and obtaining an alignment element;

positioning the doctor blade assembly in a toner hopper of a toner printer cartridge, wherein the toner hopper has a pair of positioning pins at each end;

aligning the respective alignment through holes, the recessed openings, and the positioning pins along a substantially straight alignment pathway; and, inserting a pair of fastener members through the respective alignment through holes and the recessed openings to set the doctor blade assembly in a desired alignment position.

12. The method of claim 11 wherein the cutting step is performed with a cutting process comprising a laser cutting process, a drilling process, a plasma arc cutting process, a water jet cutting process, an oxyfuel cutting process, a die cutting process, and an etch cutting process.

13. The method of claim 11 wherein the step of cutting the pair of recessed openings comprises cutting a plurality of angled sidewalls for each recessed opening.

14. The method of claim 11 wherein the step of cutting the pair of recessed openings comprises cutting a plurality of straight sidewalls for each recessed opening.

15. The method of claim 11 wherein the step of cutting the pair of recessed openings comprises cutting an outer profile of each recessed opening in a shape selected from a group consisting of a rectangle, a trapezoid, a triangle, a rectangle, a trapezoid, a triangle, a square, a pentagon, a hexagon, a circle, and an oval.

16. The method of claim 11 wherein the step of forming the predetermined alignment through hole comprises forming the alignment through hole at a location in the alignment element based on a determination of a symmetry line measurement position selected from a group consisting of a height measurement of the alignment element divided by two, a height measurement of the alignment element divided by three, and a height measurement of the alignment element divided by four.

17. The method of claim 11 wherein the step of inserting the pair of fastener members comprises inserting each fastener member having a length greater than a thickness of each alignment element.

18. The method of claim 11 wherein the positioning and aligning steps do not require use of a spacer element or a fixture element to align or to adjust a desired alignment position of the doctor blade assembly in the toner hopper of the toner printer cartridge.

* * * * *